US006423165B1

(12) United States Patent
Hishinuma

(10) Patent No.: US 6,423,165 B1
(45) Date of Patent: Jul. 23, 2002

(54) METHOD OF MAKING CONVEXITIES AND/OR CONCAVITIES ON CLOTHS OF A GARMENT

(76) Inventor: Yoshiki Hishinuma, 10-4, Jingumae 4-chome, Shibuya-ku, Tokyo (JP)

( * ) Notice: Subject to any disclaimer, the term of this patent is extended or adjusted under 35 U.S.C. 154(b) by 0 days.

(21) Appl. No.: 09/472,808

(22) Filed: Dec. 28, 1999

(30) Foreign Application Priority Data

Dec. 28, 1998 (JP) ..... 10-372211
Apr. 1, 1999 (JP) ..... 11-095598
May 14, 1999 (JP) ..... 11-133623

(51) Int. Cl.[7] ..... D06C 23/04; B32B 3/06

(52) U.S. Cl. ..... 156/85; 156/91; 264/138; 264/221; 264/230; 264/317; 264/324; 26/18.5; 28/156; 28/164; 28/170; 112/117; 112/427; 112/439; 112/475.09; 112/475.22; 112/132

(58) Field of Search ..... 156/85, 97; 264/319, 264/324, 322, 230, 138, 221, 317; 112/117, 132, 403, 420, 427, 439, 440, 425.08, 425.09, 475.22; 26/18.5; 28/156, 163, 164, 168, 170

(56) References Cited

U.S. PATENT DOCUMENTS 3,657,060 A * 4/1972 Haigh ..... 428/175
RE33,215 E * 5/1990 Sweet ..... 2/243.1
5,356,055 A * 10/1994 Takizawa ..... 223/28
6,251,210 B1 * 6/2001 Bullock et al. ..... 156/272.2

FOREIGN PATENT DOCUMENTS

| | | | |
|---|---|---|---|
| JP | 06-240563 | * | 8/1994 |
| JP | 08-003864 | * | 1/1996 |
| JP | 8-218213 | | 8/1996 |
| JP | 9-087969 | | 3/1997 |
| JP | 9-031839 | | 4/1997 |
| JP | 10-168747 | | 6/1998 |

* cited by examiner

*Primary Examiner*—Jan H. Silbaugh
*Assistant Examiner*—Stefan Staicovici
(74) *Attorney, Agent, or Firm*—Sughrue Mion, PLLC

(57) ABSTRACT

A method for forming convexities and/or concavities on cloths for a garment at almost entire portions of the garment or any desired portion of the garment without any substantial limitation from a design point of view. The method for forming a garment having convexities and/or concavities which can expand and contract in both the weft and wrap directions like a knitted fabric. Cloths including thermoplastic fiber are cut into parts of the garment, the parts are sewn in a shape of the garment. The garment is overlaid on a thermo-shrinkable cloth. They are sewn together with stitches of water-soluble threads. The sewn cloths are heated under dry heat and without applying any pressure to the cloths so as to permit the thermo-shrinkable cloth to shrink and form convexities and/or concavities on the cloths of the garment. The water-soluble threads are solved and removed, and the cloths of the garment are separated from the thermo-shrinkable cloth.

10 Claims, 17 Drawing Sheets

METHOD OF MAKING CONVEXITIES AND/OR CONCAVITIES ON CLOTHS OF A GARMENT

BACKGROUND OF THE INVENTION

1. Field of the Invention

This invention relates to a garment and method for forming convexities and/or concavities on cloth for a garment.

2. Prior Art

One of conventionally known methods for forming convexities and/or concavities on cloth for a garment is a traditional tie dyeing method wherein the cloth is tied up with threads and so called "dappled cloth" is obtained. Pleating method is also known as another method for forming convexities and/or concavities on cloth for a garment.

In a generally known pleating method, pleats are formed in cloth before it is formed in a garment, and then the pleated cloth is cut and the garment is sewn. However, when the pleated cloth is sewn to a garment, it is necessary for an operator to sew the cloth while he is pressing the pleats. Thus, there are disadvantages that sewing operation is troublesome and that sewing with a sewing machine is difficult since folded cloth is sewn.

In order to obviate such disadvantages, proposed is a method wherein cloth sewn in a shape of garment is subjected to the pleating operation (for example, Japanese Patent Publication No. 56-9561 and No. 4-23026).

However, since pleats are forcedly formed by a machine in the conventional pleating, the shape of the thus formed pleats is in a regular straight line condition. Further, since the pleats are necessarily regular shape, possible variation is poor from a design point of view.

In order to vary pleats, for example Japanese Patent No. 2504931 discloses that a garment or a garment in a half finished goods is wrapped with a flexible sheet and is twisted, and that after it is tied with a cord, it is put in a heat treating device so as to form pleats. Although thus obtained pleats are not in a completely straight condition which has been common for conventional pleats, only wrinkles in an oblique condition are formed since they are formed by twisting. variation is still poor. Further, according to this method, it is impossible to form pleats at desired portions in a garment, and thus, variation in design is limited.

Differing from the conventional pleating, proposed is a method wherein a heat-shrinkable and water-soluble thread is used to form plaits or wrinkles. Japanese Patent Application Laid-open No. 8-218213 and 9-87963 disclose that desired potions in a garment made of a thermoplastic material are tacked with a heat-shrinkable and water-soluble thread and are heated to shrink the heat-shrinkable and water-soluble thread to form plaits, and then, the heat-shrinkable and water-soluble thread is solved and removed with warm water so that plaits are formed on the desired positions on the garment.

Japanese Patent Application laid-open No. 9-31839 discloses that a water-soluble thread having shrinkable property and a non-shrinkable thread are interwoven, and the shrinkable and water-soluble thread is shrunk, and then, the water-soluble thread is solved and removed so as to form wrinkles in the cloth.

When convexities and/or concavities are formed on cloth in accordance with the conventional tie dyeing method, there are advantages that the convexities and/or concavities can be formed at any desired portions in the garment and that the shape of the convexities and/or concavities can be formed at will. However, this method has disadvantages that operation is very long time consuming since a thread has to be wound around each portion in the cloth where a convexity is desired to be formed, and that accordingly, the garment thus formed becomes very expensive.

Contrary to this, according to a pleating method wherein folds are mechanically formed as it is common in the conventional pleating methods, there is a disadvantage that design variation is poor. In addition, the cloth can be expanded and contracted in a direction perpendicular to the folds but cannot be expanded or contracted in a direction of the folds. Consequently, even when pleats are formed in entire portions of a garment, the direction wherein the garment can be expanded and contracted is limited to a direction perpendicular to the creases. In other words, the thus obtained garment is somewhat different from knitted fabric, which can expand and contract in both the weft and warp directions, and it is difficult to fit any persons who may have various body shapes.

If stitches are sewn at predetermined portions of a garment with heat-shrinkable and water-soluble threads so as to form convexities and/or concavities as disclosed in Japanese Patent Application Laid-open No. 8-218213 or 9-87963, the portions of the garment cannot be fully contracted due to the force created by the cloth since the contraction is done only by the thread. Accordingly, only a small amount of wrinkles can be formed. Further, this method cannot be applicable to a thick cloth, and thus, according to this method, wrinkles only with very small convexities and concavities can merely be obtained.

Besides, as described above, since only very small convexities and concavities are merely obtained as uneven surface according to this method, variation can not be expected from a design point of view.

When a water-soluble thread having shrinkable property is interwoven as disclosed in Japanese Patent Application Laid-open No. 9-31839, there is a problem that the kinds of cloth are limited, and also there is a disadvantage that a shrinkable thread can be only woven straight along the weft or warp direction since it is interwoven. In other words, any desired cloth cannot be used for this method, and contracting portions cannot be set at will, and thus it is very difficult to vary its design.

SUMMARY OF THE INVENTION

It is an object of the present invention to provide a method for forming convexities and/or concavities on cloth for a garment by which convexities and/or concavities can be formed at almost entire portions of the garment or any desired portion of the garment without any substantial limitation from a design point of view.

It is another object of the present invention to provide a method for forming a garment having convexities and/or concavities which can expand and contract in both the length and breadth directions like a knitted fabric such that convexities and/or concavities are formed at entire portions of the garment or any desired portion of the garment.

It is another object of the present invention to provide a method by which convexities and/or concavities can be formed in cloth for a garment and by which a part or parts of the surface of the cloth for the garment can be varied.

It is still another object of the present invention to provide a method by which clear convexities and concavities like as rib-knitting and big convexities and concavities like as rope-knitting can be formed in cloth, or by which clear convexities and concavities can be formed in a thick cloth. Further, the present invention. It is still another object of the present invention to provide a garment which has such clear convexities and concavities in the cloth thereof.

DESCRIPTION OF THE INVENTION

In accordance with the present invention, a method for forming convexities and/or concavities on cloth for a garment comprises:

cutting a cloth or cloths including thermoplastic fiber into parts of the garment;

sewing the parts into a shape of the garment;

laying at least one piece of thermo-shrinkable cloth on at least one part of at least one of the cloths of the garment after or before said sewing;

sewing the thermo-shrinkable cloth, and the garment or the cloth thereof with stitches of water-soluble threads;

heating the sewn cloths by heating means under dry condition and without applying any pressure to the cloths so as to permit the thermo-shrinkable cloth to shrink and form convexities and/or concavities on the cloth or cloths of the garment; and solving and removing the water-soluble thread so as to separate the cloth of the garment from the thermo-shrinkable cloth.

The convexities and concavities may be gathers.

The method may further comprise subjecting the cloth or cloths of the garment to sublimation transfer printing before or after solving and removing the water-soluble thread.

The method may further comprise adhering a sheet-like material to the cloth or cloths of garment after said solving and removing.

In accordance with another aspect of the present invention, a method for forming convexities and/or concavities on cloth for a garment comprises:

overlaying a cloth or cloths including thermoplastic fiber, cloths of parts of the garment made by cutting the cloth or cloths, or cloths of a garment made by sewing the parts on a thermo-shrinkable cloth and sewing them together with first stitches of water-soluble threads;

sewing the sewn cloths with second stitches of water-soluble threads parallel to the first stitches in such a manner that the sewn cloths are picked up and tucked around the first stitches;

heating the stitched cloths so as to permit the thermo-shrinkable cloth to shrink and form convexities and/or concavities on the cloth or cloths; and solving and removing the water-soluble threads so as to separate the cloth or cloths of the garment from the thermo-shrinkable cloth.

The tucked width upon making tucks in the cloths sewn by the first stitches may be between 1 to 20 mm.

The picking up may be alternately performed from the front side and the back side of the stitched cloths, upon making tucks in the cloths sewn by the first stiches.

Three rows of first stitches may make a set, each rows of first stitches locating at the center of the tuck upon picking up the cloths sewn by the first stitches and the distance between adjacent rows of the first stitches being between 10 and 20 mm. The sewn cloths may be picked up at the first stitches locating at the center of the set by a wide picking up width toward the cloth including the thermoplastic fiber and are tucked with the second stitches of the water-soluble thread. The sewn cloths may be picked up at the rows of the first stitches locating at both sides of the set by a narrow picking up width toward the thermo-shrinkable cloth and are tucked with the second stitches of the water-soluble thread, and the stitched cloths are heated and the water-soluble threads are solved and removed, whereby a large projection is formed in the cloths including the thermoplastic fiber as a result of cooperation of the set of the three rows of first stitches and the second stitches forming three tucks at the three rows of first stitches.

The thermo-shrinkable cloth may be cut at least at one position between the adjacent rows of stitches, after the cloth including the thermoplastic fiber and thermo-shrinkable cloth are overlaid and sewn together with the stitches of the water-soluble threads, and thereafter, the sewn cloths are heated.

In accordance with another aspect of the present invention, a method for forming convexities and/or concavities on cloth for a garment comprises:

filling filler between a cloth for right side including thermoplastic fibers and a cloth for lining including thermoplastic fibers, and quilting them with water-insoluble threads to form quilted cloths for a garment;

overlaying the quilted cloths on a thermo-shrinkable cloth and sewing them together with stitches of a water-soluble threads, the sewing being done by a plurality of sets, each set comprising two or three rows of stitches parallel to each other by a small distance therebetween, and adjacent sets forming a distance at least three times larger than the small distance;

heating the sewn cloths so as to permit the thermo-shrinkable cloth to shrink and form convexities and/or concavities on the quilted cloths; and thereafter, solving and removing the water-soluble thread so as to separate the quilted cloth from the thermo-shrinkable cloth.

In accordance with another aspect of the present invention, a cloth including thermoplastic fibers and having a heat setting property, has stripe-shaped convexities and concavities, each of which has a first series of needle holes extending in a longitudinal direction thereof at the top of the convexity or the bottom of the concavity and each of which has two second series of needle holes extending in a longitudinal direction thereof and parallel to the first series of needle holes at both sides of the first series of needle holes, the second series of needle holes locate at the base portion or intermediate portion of the convexity or concavity, and the convexity or concavity has small pleats or convexities and/or concavities formed.

The cloth may be used for a garment.

In accordance with another aspect of the present invention, a garment made of cloths, including thermoplastic fibers, in which the cloths has stripe-shaped convexities or concavities, each of which has a first series of needle holes extending in a longitudinal direction thereof at the top of the convexities or the bottom of the concavities and each of which has two second series of needle holes extending in a longitudinal direction thereof and parallel to the first series of needle holes at both sides of the first series of needle holes, the second series of needle holes locate at the base portion or intermediate portion of the convexities or concavities, and the convexities or concavities has small pleats or convexities and/or concavities formed thereon.

BRIEF DESCRIPTION OF THE SEVERAL VIEWS OF THE DRAWINGS

Some embodiments of the present invention will now be explained with reference to the accompanying drawings, wherein.

DETAILED DESCRIPTION OF THE INVENTION

Figure 1:
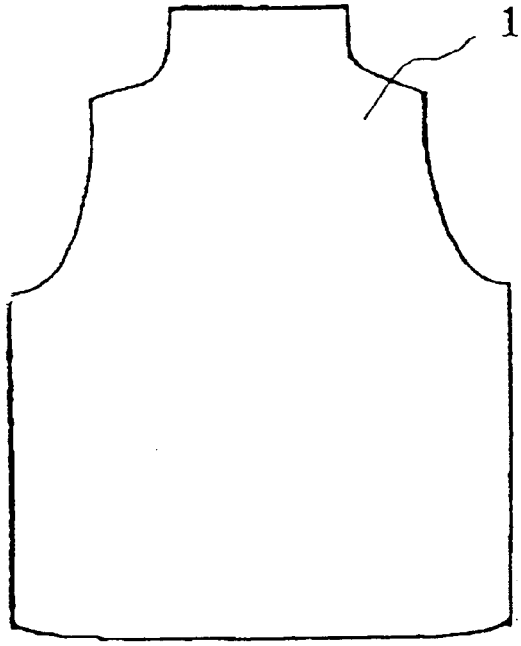
FIG. 1(*a*) to FIG. 1(*c*) are plan views diagrammatically explaining the steps for manufacturing a garment according to the present invention.
Figure 1:
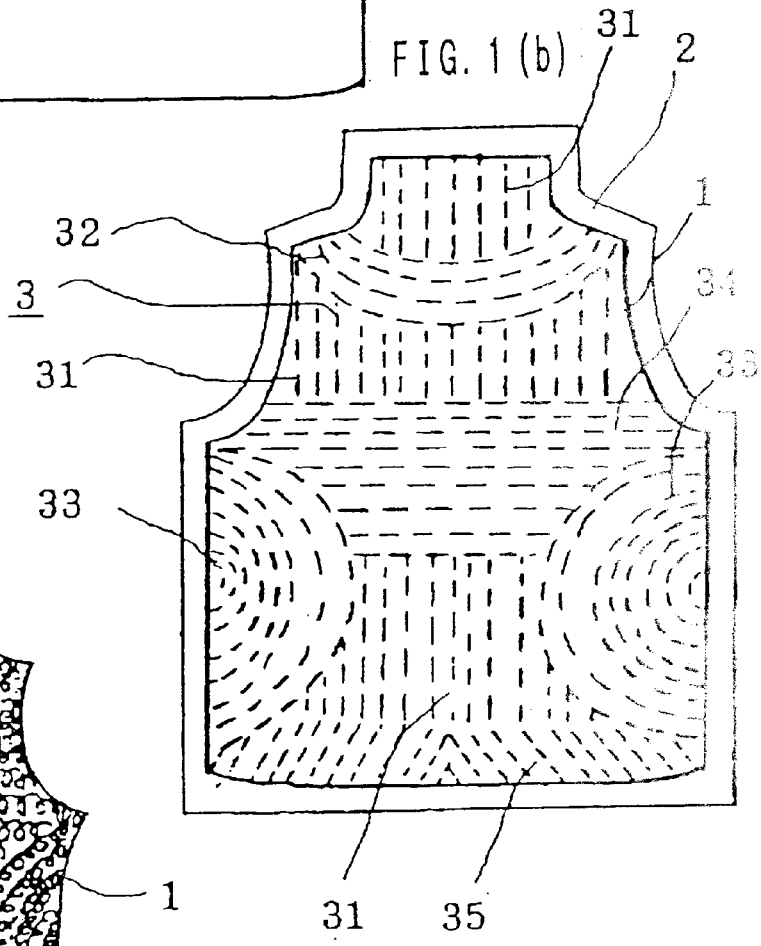
Figure 1:
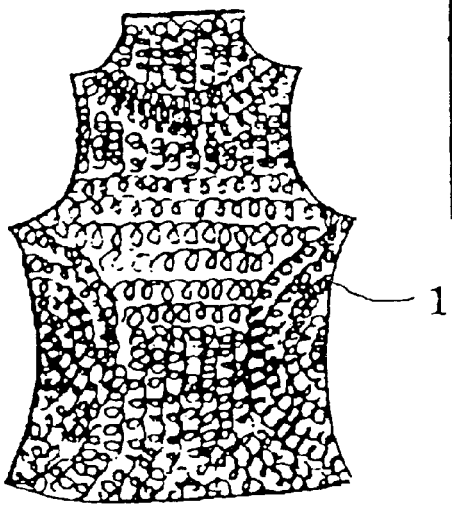

Some embodiments of the present invention will now be explained with reference to the accompanying drawings. FIG. 1(*a*) to FIG. 1(*c*) are plan views diagrammatically explaining the steps for manufacturing a garment according to the present invention. First, a cloth or cloths including thermoplastic fibers are cut into parts of the garment, and the parts are sewn in a shape of the garment as illustrated in FIG. 1(*a*). The thermoplastic fibers are not especially limited as long as it is possible to be heat-set, and among them, polyester fiber is preferable. From a view point of heat-set, cloth including more than 50% of thermoplastic fibers is used, and it is preferred to use cloth including thermoplastic fiber between 70 and 100%.

Since the garment manufactured by the method according to the present invention finally has convexities and/or concavities formed in the cloth thereof, and the size of the finished garment will be contracted by 10 to 65% from the material cloth, taking the contraction into consideration, the cloth has to be cut in a larger shape, i.e., 1.1 to 2.8 times as large as the finished size, when the cloths are cut into parts, and then the parts are sewn into a shape of the garment. The above-described "shape of the garment" may be a shape of a complete garment wherein all the parts are sewn or a shape of a particular portion of a garment (for example, a body part in a garment with sleeves). When the parts are sewn into the shape of the particular portion of the garment at this stage, after the method of the present invention which will now be explained is carried out to the particular portion, the particular portion may be sewn with the remaining parts to complete the garment.

Then, the garment formed by the cloths 1.1 is overlaid on a thermo-shrinkable cloth 2 (for example, "Teviron" (Registered Trademark) cloth made of polyvinyl chloride and manufactured by Teijin Ltd. is used in the embodiment), and they are sewn by means of a sewing machine etc. with stitches of water-soluble threads 3 (see FIG. 1(*b*). That is, the front side and back side cloths 1,1 of the garment are sewn with the thermo-shrinkable cloth 2 at the same time. In the specification, the term "garment" may be used as "garment"

having front and back side cloths. The water-soluble thread 3 may be, for example, "Solvron" (Registered Trademark) manufactured by Kabushiki-Kaisha Nitivy.

The stitches can be sewn in any directions and patterns at will by means of a sewing machine, and thus, any desired design can be realized. In the embodiment illustrated in FIG. 1(*b*), for example, a plurality of parallel and vertical rows of stitches 31 are formed at the neck portion, breast portion and the waist portion, rows of stitches 32, each forming an arc along a neckline, formed around the neckline, rows of stitches 33 forming arcs at both side portions, horizontal rows of stitches 34 at the breast portions and oblique stitches 35 at the bottom portion, and thus, whole the cloth 1 of the garment is sewn with the thermo-shrinkable cloth 2. The distance between the adjacent rows of the stitches 31, 32, 33, 34, or 35 may be optionally set. When stitches are formed in the entire portions of the garment as illustrated in FIG. 1(*b*), though the suitable distance may depend on thickness of the cloth of the garment or the like, the distance between about 6 and 10 mm, for example, is suitable for relatively thin cloth taking the formed convexities and/or concavities into consideration.

The cloths 1,1 of the garment and the heat-shrinkable cloth 2 which have been sewn together are heat-treated under a dry condition so as to permit the thermo-shrinkable cloth 2 to shrink and form convexities and/or concavities in the cloths 1,1 of the garment. At the time, the corresponding portions of the front and back clothes 1,1 have convexities or concavities in an inverse manner. Therefore, the garment is made into good feeling.

The heat-shrinkable cloth 2 used in the present invention has a thermo-shrinkage percentage between 20 and 60%, preferably at least 30%, for at least one of the weft and warp directions. The thermo-shrinkable cloth 2 using thermo-shrinkable yarns for both the weft and warp yarns is preferable since it contracts in both the direction, however, cloth using a thermo-shrinkable 20 yarn for either the weft or warp yarn and capable of being contracted in either one of the weft and warp directions may be used. The thermo-shrinkage percentage may differ in the warp and weft directions. Thread using polyvinyl chloride fiber or polyurethane fiber, such as "SPANDEX" (Trademark), for example, is suitable for the thermo-shrinkable thread.

In order to make the garment having strechability like as knit goods, it is preferred to use thermo-shrinkable cloth 2 having thermo-shrinkage percentage about 50% in both the weft and warp directions. Teviron cloth manufactured by Teijin Ltd. woven with "TEVIRON" filament yarns having thickness of between 50 and 100 denier (55 and 110 dtex) for the weft and warp yarns, for example, may be used as the thermo-shrinkable cloth 2.

The heating temperature according to the present invention may be between 140 and 195° C., and the heating time may be between 40 sec and 6 minutes depending on the thickness of the cloths and the sewn patterns. When it is desired to heat for 6 minutes, the heating operation may be divides, for example, into three times, each continues for two minutes. Although the cloths are made of the same material, the time may differ depending on their sizes or the sewn patterns. Further, in case of thick cloth or thickness of the sewn cloth being big due to tucking, the required heating time may vary, and accordingly, it is recommended to appropriately adjust the heating time and temperature through previously performed trial manufacture.

For example, in case that relatively thin cloth is sewn with stitches as illustrated in FIG. 1(*b*), it is heated for about between 45 and 60 sec. by means of the heating plate heated at between 190 and 195° C. under dry heat and without applying any pressure to the cloths, the thermo-shrinkable cloth 2 is contracted in both the warp and weft directions.

When the cloths 1,1 to be a garment of relatively thin and Teviron cloth which may shrink about 50% are used, the dimensions in both the warp and weft directions were reduced to about half of the original dimensions after the heating operation. Even after the thermo-shrinkable cloth 2 is contracted and becomes small, the cloths 1,1 of garment remain its original size, and accordingly, surplus in the cloths 1,1 are floated at the portions which are not sewn and forms convexities or projections, and concavities or depressions are made at the portions sewn by the stitches 31, 32, 33, 34 and 35.

Thereafter, the sewn cloths 1 and 2 are dipped in hot water of between 70 and 90° C. so as to solve and remove the water-soluble thread 3, and thus the connection between the cloths 1,1 of garment and the thermo-shrinkable cloth 2 is dismissed, and then the thermo-shrinkable cloth 2 is peeled off from the cloths 1,1 of garment. As a result, such a garment as illustrated in FIG. 1(*c*) has many convexities and/or concavities and is expandable in both the length and breadth directions is obtained.

As shown in FIG. 1(*c*), convexities and/or concavities are formed in such a shape as arcs at the portion near the neckline and the side portions where the rows of stitches 32 and 33 ware sewn along arcs, and convexities and/or concavities form straight lines at the breast portion and the body portion where the rows of stitches 31, 34 and 35 were sewn in straight lines. This phenomenon is caused by the contraction of the thermo-shrinkable cloth in both the warp and weft directions.

Figure 2:
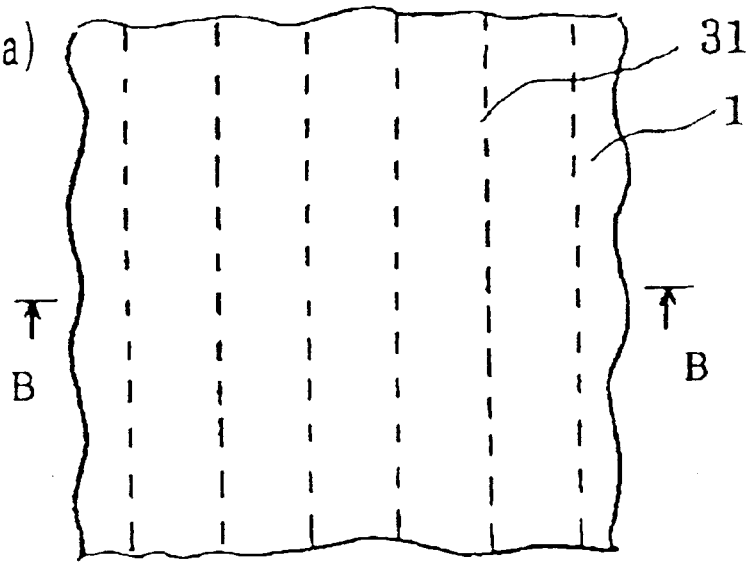
FIG. 2 is a schematic view in an enlarged scale than FIG. 1 for explaining the condition wherein the cloth for the garment and the heat-shrinkable cloth are sewn together with a water-soluble thread, wherein FIG. 2(*a*) is a plan view wherein a plurality of rows of stitches are formed on the straight and in parallel, FIG. 2(*b*) is a cross sectional view taken along line B—B in FIG. 2(*a*), FIG. 2(*c*) is a plan view of the cloth having convexities and/or concavities formed thereon, FIG. 2(*d*) is a cross sectional view taken along line D—D in FIG. 2(*c*), and FIG. 2(*e*) is a cross sectional view taken along line E—E in FIG. 2(*c*)
Figure 2:
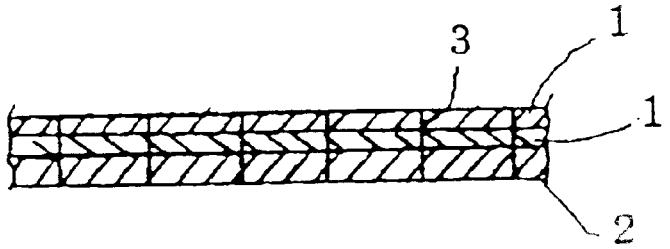
Figure 2:
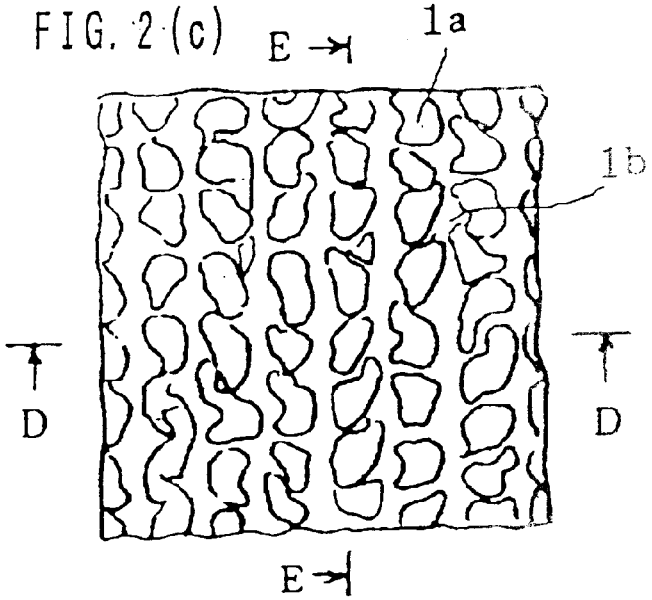
Figure 2:
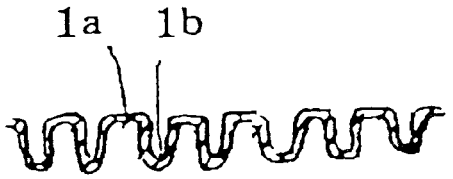

FIG. 2 is a schematic view in an enlarged scale than FIG. 1 for explaining the condition wherein the cloths 1,1 of garment and the heat-shrinkable cloth 2 are sewn together with a water-soluble thread 3 and the condition for forming convexities and/or concavities in the cloths 1,1. FIG. 2(*a*) is a plan view wherein a plurality of rows of stitches are formed on the straight and in parallel, FIG. 2(*b*) is a cross sectional view taken along line B—B in FIG. 2(*a*), wherein the thickness of the cloths 1 and 2 is exaggerated from their actual thickness. FIG. 2(*c*) is a plan view of the cloths 1,1 having convexities and/or concavities formed therein, and FIG. 2(*d*) is a cross sectional view taken along line D—D in FIG. 2(*c*),.

As illustrated in FIGS. 2(*c*) and 2(*d*), convexities and/or concavities, which comprise projections 1*a* and depressions 1*b* forming a straight line, respectively, are formed in the cloth 1. Although the convexities or projections 1*a* and the convexities or depressions 1*b* seem to be regular in FIGS. 2(*c*) and 2(*d*) (please note that FIG. 2 is schematically illustrated), and they are irregular in their actual forms. More specifically, the portions which have been fixed to each other with stitches 3 are contracted together with the thermo-shrinkable cloth 2 and are restricted by the stitches 3, and thus they turn into small pleats, and they form continuous depressions 1*b* as a whole. Contrary to this, since the portions between the adjacent rows of the stitches 3 are not fixed, they are floated great, and thus projections 1*a* appear discontinuously. Since the projections 1*a* are discontinuous, they are to be recognized as like projections created by tie dyeing rather than pleats.

Figure 3:
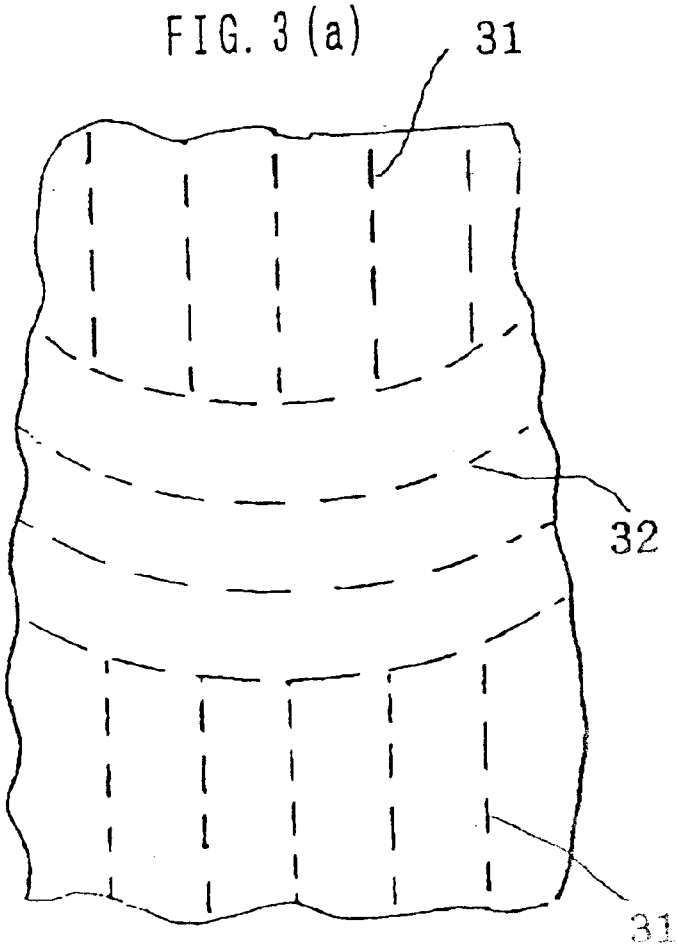
FIG. 3 is a schematic view similar to FIG. 2, wherein FIG. 3(*a*) a plan view wherein a plurality of rows of stitches are horizontally formed in parallel and along a curve, and FIG. 3(*b*) is a plan view of the cloth which has obtained by thermally shrinking one illustrated in FIG. 3(*a*) to form convexities and/or concavities.
Figure 3:
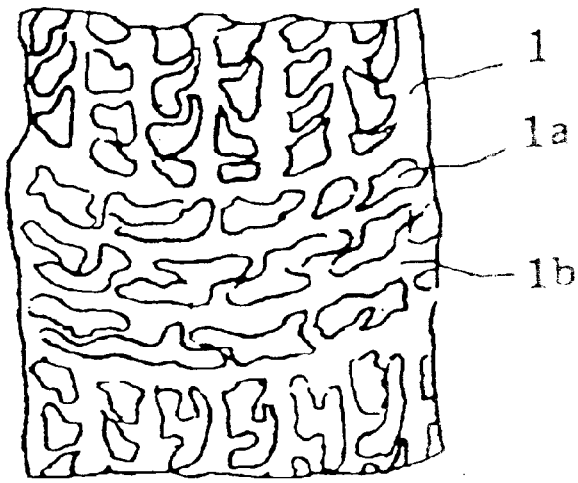

FIG. 3 is a schematic view similar to FIG. 2, wherein FIG. 3(*a*) a plan view wherein a plurality of rows of stitches are horizontally formed in parallel and along a curve such as neckline portion, and FIG. 3(*b*) is a plan view of the cloth which has obtained by thermally shrinking such a cloth to form convexities and/or concavities. As illustrated in FIG. 3(*b*), the portions where rows of stitches have been sewn along curves form curved continuous depressions 1*b*, and projections 1*a* appear discontinuously between the one depression and the adjacent depression and locate along curves.

Figure 4:
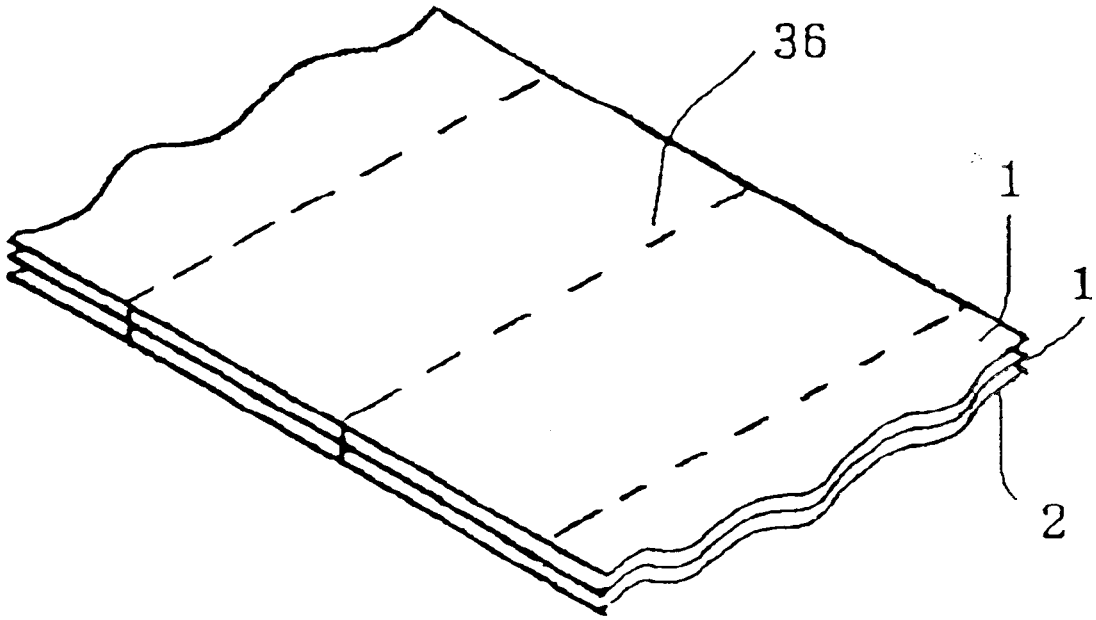
FIG. 4(*a*) and FIG. 4(*b*) are perspective views showing other methods for forming stitches according to the present invention.
Figure 4:
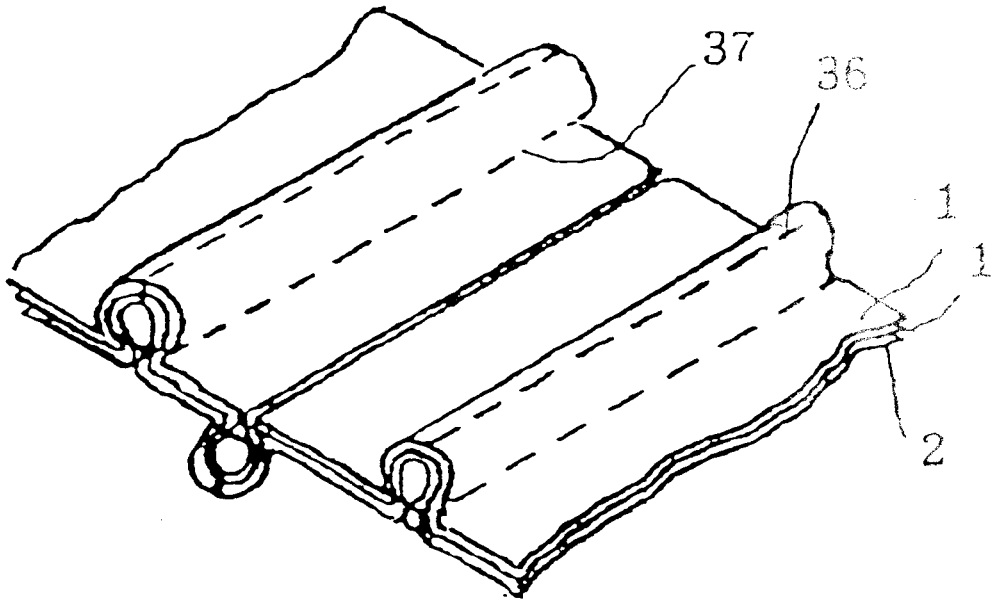

FIG. 4 is a perspective view showing another method for forming stitches different from the above-described embodiment. The cloths 1 of garment are overlaid on the thermo-shrinkable cloth 2, and under this condition, they are sewn with a water-soluble thread 3 while they are picked up and tucked alternately from the front side and the back side of the stitched cloths like pin-tuck, and thus convexities and/or concavities like as rib-knitting, are formed. According to the present invention, the tucked width upon making tucks in the stitched cloths is appropriately selected between 1 to 20 mm taking into consideration the size of the convexities and/or concavities to be formed and is not limited to between 1 and 1.5 mm which is common for usual pin-tuck.

In this embodiment, as illustrated in FIG. 4(*a*), the overlaid cloths 1 and 2 are sewn with stitches 36 of water-soluble thread 3 so as to prevent their mutual displacement. Then, as illustrated in FIG. 4(*b*), the sewn cloths 1 and 2 are picked up in a tucked manner around the stitches 36, toward, for example, the front side, i.e., toward the opposite side of the thermo-shrinkable cloth 2. In other words, they are picked up along the rows of stitches 36, at the rows of stitches 36 locating at the top of the picked up portion. Stitches 37 are sewn at the base of the picked up portion with a water-soluble thread 3 by means of a sewing machine like pin-tuck. In this specification, the stitches sewn at the base portion of the picked up portion will be referred to as "tuck stitches" hereinbelow. Then, the cloths 1 and 2 are picked up at the adjacent rows of stitches 36 toward the back side, i.e., toward the side of the thermo-shrinkable cloth 2, and tuck stitches 37 are sewn with a water-soluble thread 3 like as pin-tuck. Such operations are alternately performed from the front side and the back side, and then, the cloths 1 and 2 are heated so as to shrink the thermo-shrinkable cloth 2, and knit-line garment is obtained after water-soluble threads 3 are solved and removed.

Although the stitches were almost uniformly formed in the entire portions of the garment in the embodiment illustrated in FIG. 1, the stitches may be formed at a part or parts of the garment but not entire portions, and they may be not uniform, i.e., the distance between the rows of stitches may be varied.

A large space may be formed between the portion where the rows of stitches are sewn at narrow distance and the adjacent portion where the rows of stitches are sewn at narrow distance. In order to prevent a portion of the cloths 1 of garment locating in the large space from being shrunk when the thermo-shrinkable cloth 2 is contracted, the thermo-shrinkable cloth having shape corresponding to the portions to be stitched may be overlaid only on the portions. Alternatively, after a large thermo-shrinkable cloth 2 is overlaid and narrow spaced rows of stitches are sewn, the thermo-shrinkable cloth 2 may be cut at the wide intermediate portion between the narrow spaced rows of stitches and the other narrow spaced rows of stitches. Then, the cloths 1 and 2 are heated so as to shrink the thermo-shrinkable cloth 2. Due to these operations, only the stitched portions of the cloths 1 of garment are contracted with the thermo-shrinkable clothe 2, and the remaining portions of the cloths 1 are not contracted. Thus, portions having convexities and/or concavities and gather-like portions are formed due to contraction.

Figure 5:
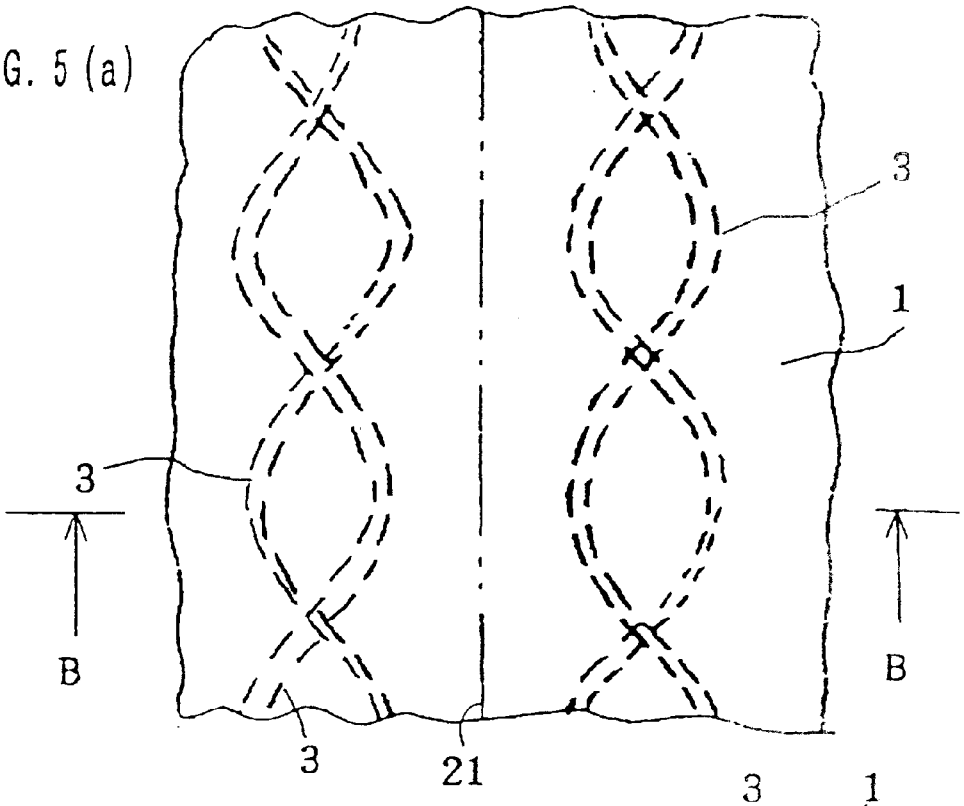
FIG. 5 is a view showing an embodiment for forming stitches, wherein FIG. 5(*a*) is a plan view, FIG. 5(*b*) is a cross sectional view taken along line B—B in FIG. 5(*a*), and FIG. 5(*c*) is a plan view of the cloth for a garment after heat treatment.
Figure 5:
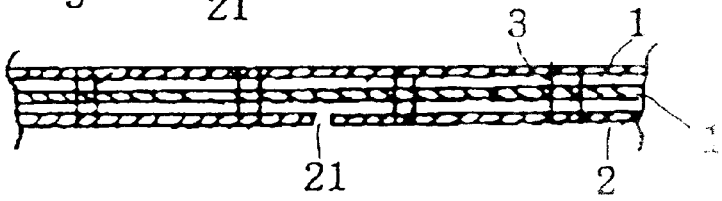
Figure 5:
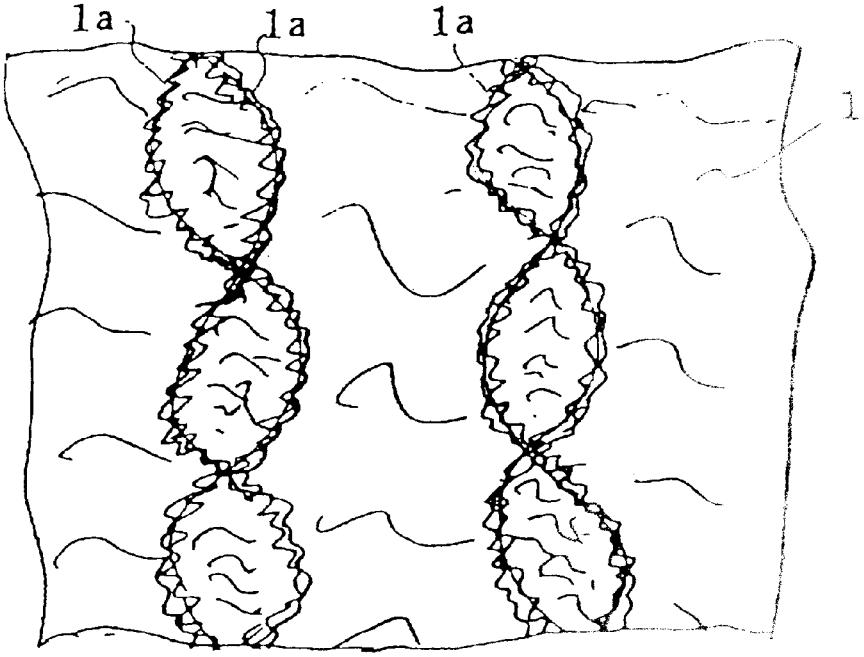

For example, FIG. 5 is a view showing an embodiment for carrying out the above-described method, wherein FIG. 5(*a*) is a plan view, and FIG. 5(*b*) is a cross sectional view taken along line B—B in FIG. 5(*a*), and FIG. 5(*c*) is a plan view of the cloths for a garment after heat treatment. As illustrated in FIG. 5(*a*), some rows of stitches (two rows of stitches in the embodiment illustrated in FIG. 5(*a*)), parallel to each other forming small distance therebetween and making a set are sewn along curved lines with water-soluble threads 3 to sew together the cloths 1 of garment and the thermo-shrinkable cloth 2. In the embodiment illustrated in FIG. 5(*a*), two sets of stitches draw a curved pattern at one portion wherein they are entangled to each other, and the curved pattern is spaced from the adjacent curved pattern. As illustrated in FIGS. 5(*a*) and (*b*), only the thermo-shrinkable cloth 2 between the adjacent sets is cut at portion 21, which is illustrated by a two-dot chain line. Under this condition, heating is carried out, and the water-soluble threads 3 are solved and removed, and when the cloths 1 are separated from the cloth 2, convexities and concavities along curves are formed in the cloths 1 of garment, and they form an aesthetic pattern like as relief as illustrated in FIG. 5(*c*). The convexities and/or concavities in this embodiment are formed by two rows of stitches forming narrow distance therebetween, protrude over the other portions, and form a pin-tuck like projections. In place of cutting the thermo-shrinkable cloth 2 at the portion 21, a thermo-shrinkable cloth formed in a tape-like shape having width somewhat wider than the width of the curved pattern may be prepared, and the tape-like thermo-shrinkable cloth may be sewn together with the cloths 1 of garment with water-soluble threads 3.

Figure 6:
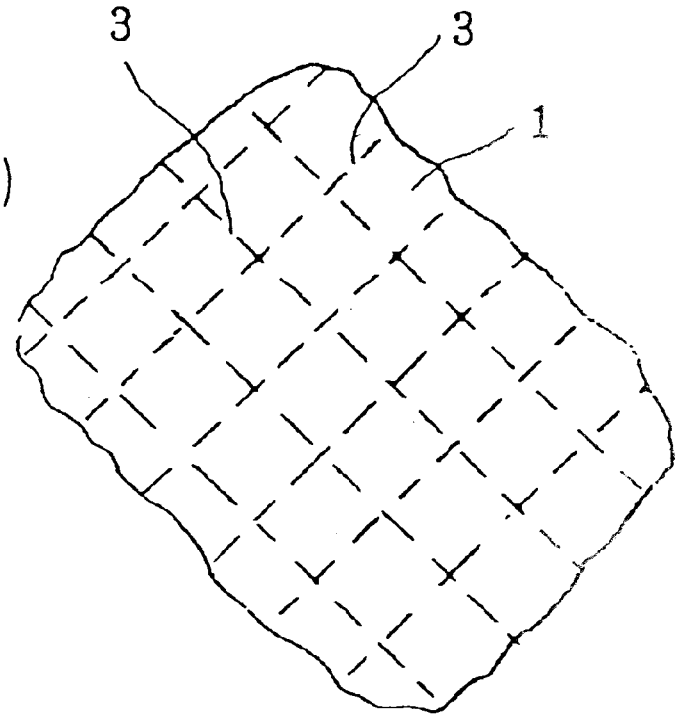
FIG. 6 shows another embodiment of the method according to the present invention, wherein FIG. 6(*a*) is a plan view of the cloths before heat treatment, FIG. 6(*b*) is a cross sectional view of the cloths before heat treatment, and FIG. 6(*c*) is a plan view of the cloth for a garment after heat treatment.
Figure 6:
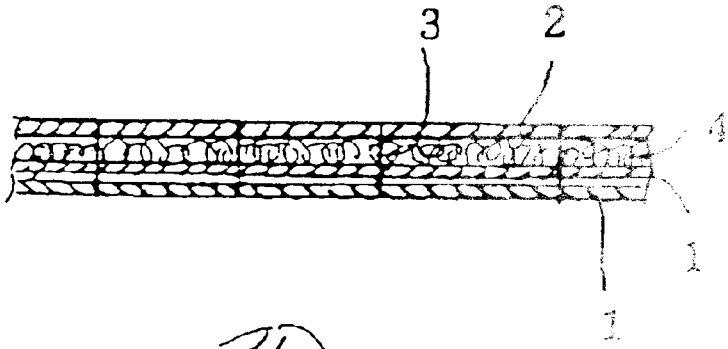
Figure 6:
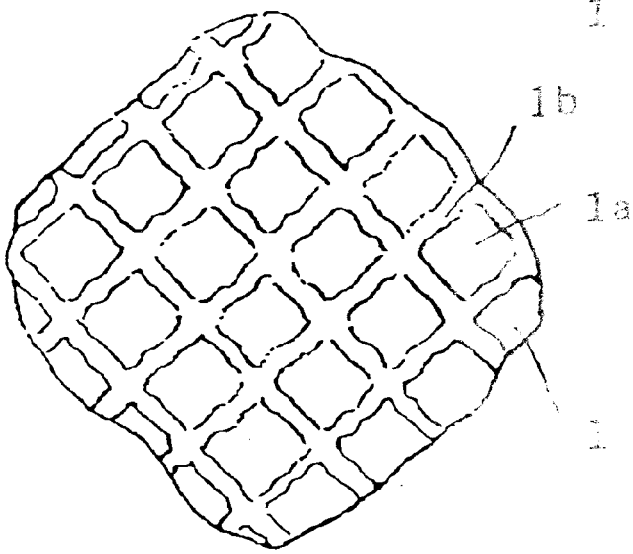

FIG. 6 shows another embodiment, wherein FIG. 6(*a*) is a plan view of the cloths before heat treatment, FIG. 6(*b*) is a cross sectional view of the cloths before heat treatment, and FIG. 6(*c*) is a plan view of the cloth for a garment after heat treatment. As illustrated in FIG. 6(*b*), a thick cotton-like sheet 4 is overlaid over two cloths of garment 1, and a thermo-shrinkable cloth 2 is overlaid thereon. Then, as illustrated in FIG. 6(*a*), stitches are sewn in an oblique cross stripe pattern with water-soluble threads 3. Thereafter, they are heated, and then, the water-soluble threads 3 are solved and removed, and when the cloths 1 are separated from the cloth 2. The obtained cloths 1 have projections la creating a diamond shape pattern and depressions 16 at the stitched portion as illustrated in FIG. 6(*c*). In this embodiment, since the stitches are sewn while the cotton-like sheet 4 is sandwiched between the cloths 1 and the cloth 2, portions in the cloths of garment which are not fixed by the stitches keep the bulked condition due to the cotton-like sheet 4 when the thermo-shrinkable cloth 2 is thermally shrunk by heating. As a result, small convexities and/or concavities are scarcely created.

Figure 7A:
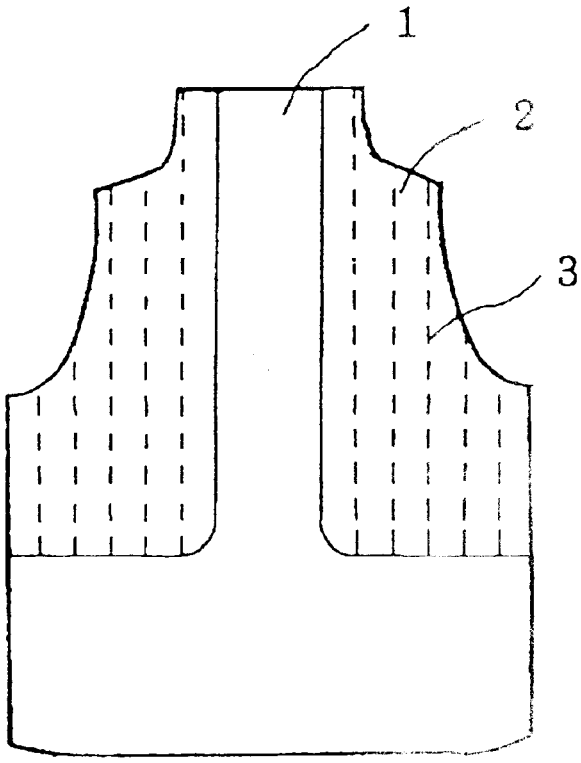
FIG. 7 shows still another embodiment of the method according to the present invention, wherein FIG. 7(*a*) is a plan view of the cloths before heat treatment, and FIG. 7(*b*) is a plan view of the cloth for a garment after heat treatment.
Figure 7B:
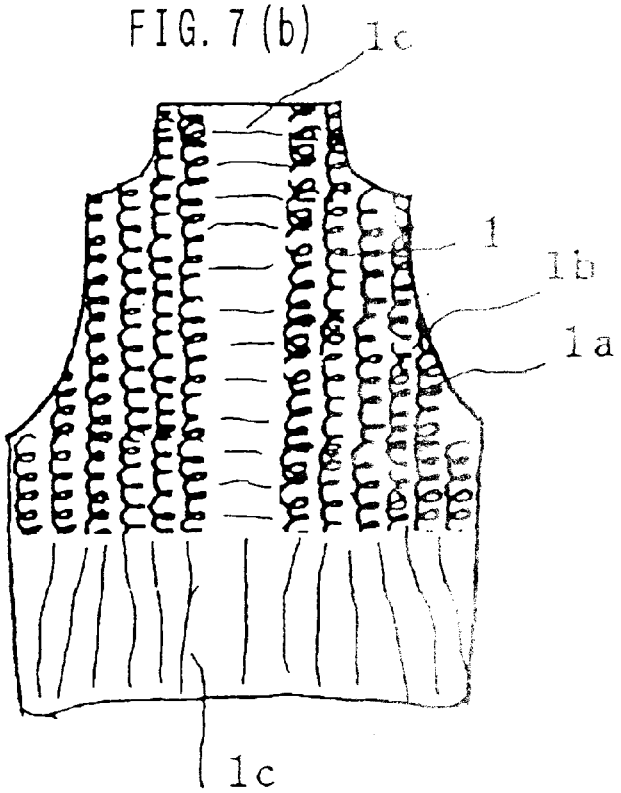

FIG. 7 shows still another embodiment of the method according to the present invention, wherein FIG. 7(*a*) is a plan view of the cloths before heat treatment, and FIG. 7(*b*) is a plan view of the cloths for a garment after heat treatment. In this embodiment, in place of stitching after overlaying the thermo-shrinkable cloth 2 over their entire portion of the garment, the thermo-shrinkable cloth 2 is partially overlaid on the cloths 1 of garment as illustrated FIG. 7(*a*), and stitches are sewn only the overlaid portions with a water-soluble thread 3. They are subjected to heat treatment so as to shrink the thermo-shrinkable cloth 2, and thereafter, they are rinsed in hot water of between 70 and 90° C. so as to remove the water-soluble thread 3. In the cloths 1 thus obtained, as illustrated in FIG. 7(*b*), small convexities and/or concavities are formed at the portion where the thermo-shrinkable cloths 2 have been overlaid. Since the portions having no thermo-shrinkable cloths 2 overlaid thereon are subjected to the heat treatment while they are wrinkled together with the convexities and/or concavities, they are heat set in a gathered condition 1*c*. According to this embodiment, in one garment, without cutting and sewing the cloths, two kinds of phenomena, i.e., small convexities and/or concavities 1*a* and 1*b* similar to those obtained by tie dyeing and gathers 1*c*, can be realized. Further, the size and disposition of the thermo-shrinkable cloths 2 and the stitching may be varied optionally, and the design can be variously changed.

In a method further developed the above-described method, after convexities and/or concavities are formed in the cloth of garment, before or after the water-soluble threads 3 are solved and removed, the cloths 1 may be subjected to sublimation transfer printing. More specifically, a thermally transfer printing sheet having sublimation dye adhered thereon is placed over the cloths 1 with convexities and concavities, and sublimation transfer is carried out for about 30 sec at about 180° C. so as to effect the printing.

Figure 8:
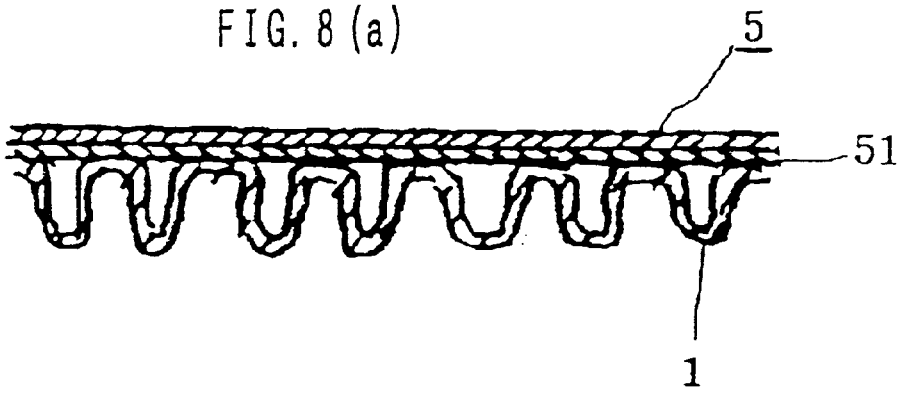
FIG. 8 shows still another embodiment of the method according to the present invention, and FIG. 8(*a*) to FIG. 8(*c*) are cross sectional views of the cloths.
Figure 8:
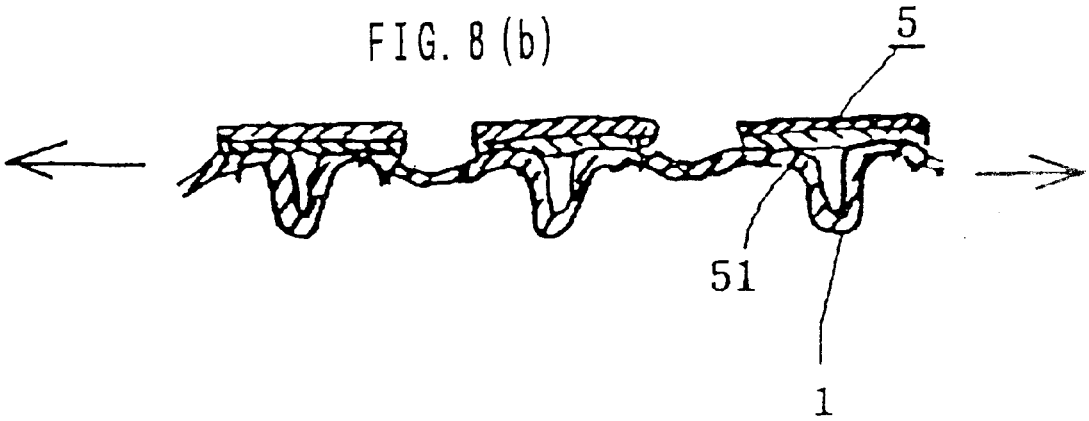
Figure 8:
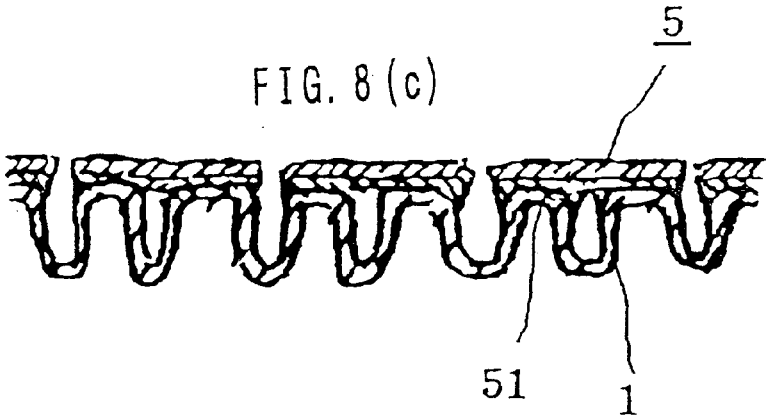

Another developed method will now be explained with reference to FIG. 8. FIGS. 8(*a*) to (*c*) are cross sectional views of a cloth. Convexities and/or concavities are formed in the cloth 1 of a garment, and after water-soluble thread is solved and removed, as illustrated in FIG. 8(*a*), a sheet-like material 5 is adhered to the cloth 1. The sheet-like material 5 is a thin sheet having hot melt adhesive layer 51 formed on one side thereof, and it can be adhered to the cloths 1 by heating. Thereafter, as illustrated in FIG. 8(*b*), when the cloth 1 having convexities and/or concavities formed therein is extended together with the thin sheet-like material 5, the thin sheet-like material 5 is broken at several positions. If the expansion is stopped, the cloth 1 contracts again forming convexities and/or concavities and becomes into such a condition as illustrated in FIG. 8(*c*). When such a garment is worn on, the gaps between the sheet-like material 5 open and amusing effect can be obtained.

The sheet-like material 5 used in this method is not limited as long as it is relatively easily broken under tension, and thin polyurethane sheet such as used on the surface of artificial leather is preferable since it affect the aesthetic influence of the cloth. An example for such a sheet is "DIMA" (Registered Trademark), a polyurethane sheet used on an artificial leather and manufactured by Komatsu Seiren Kabushiki-Kaisha. Using such a sheet, the cloth can have surface of strange feeling since it has skin of an artificial leather thereon, and thus, a garment of remarkably fresh design can be obtained due to the surface together with the convexities and/or concavities. Further, when a release paper having uneven pattern, such as snake skin pattern, is used as a release paper for the polyurethane sheet, the pattern will also appear on the urethane sheet, and accordingly, the surface of the cloth also has uneven pattern of the release paper and is amusing. Varying the pattern of the release paper, the pattern appearing on the garment which is the final product may be variously changed. Further, since the garment has polyurethane sheet on the cloth thereof, water repellency and property for keeping warm can be obtained.

Figure 9:
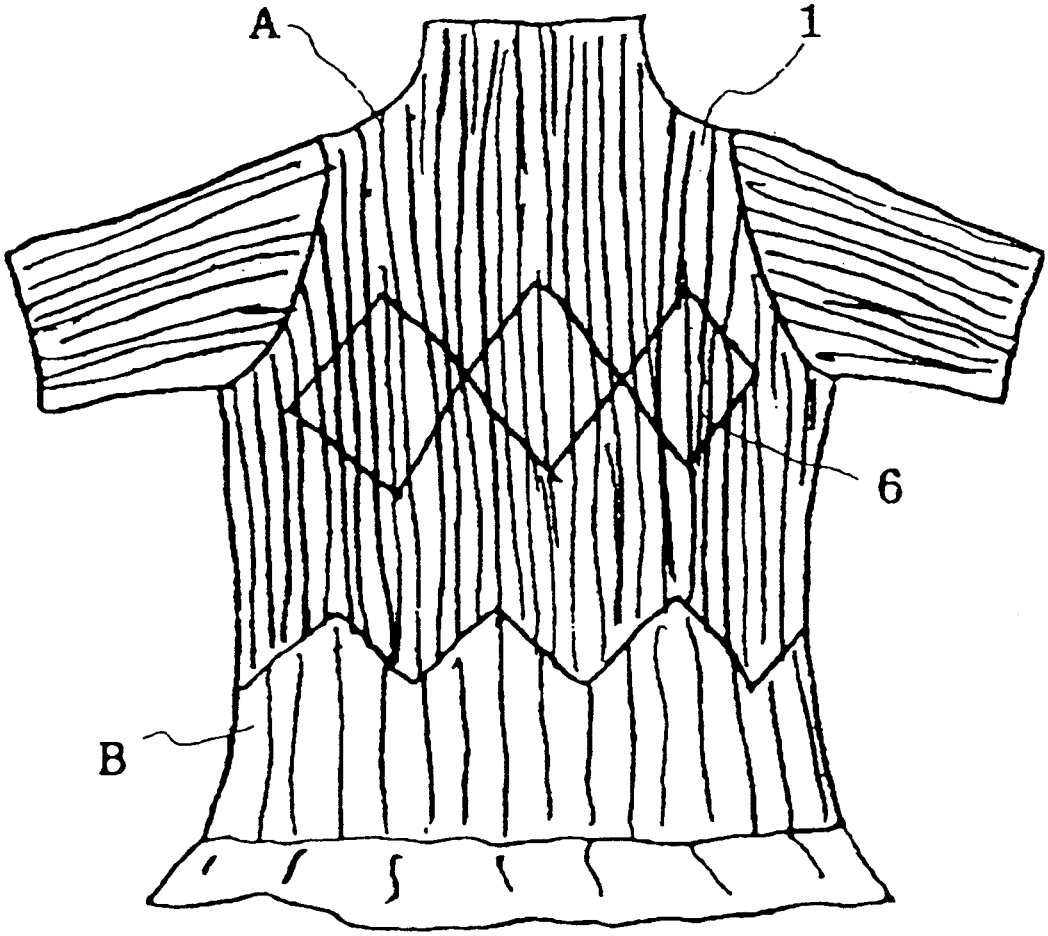
FIG. 9 shows still another embodiment of the method according to the present invention, wherein FIG. 9(*a*) is a plan view of the obtained garment, and FIG. 9(*b*) is a cross sectional view of the cloths used for the front body part of the garment.
Figure 9:
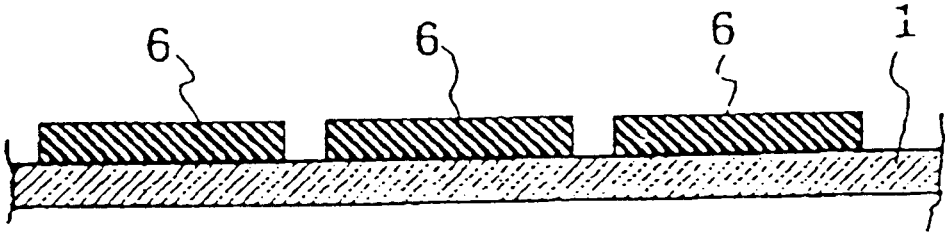

FIG. 9 shows another more definite embodiment. FIG. 9(*a*) is a plan view of the obtained garment. As illustrated in FIG. 9(*a*), this garment has diamond shaped pattern formed at the breast of the front body part, in addition, narrow vertical convexities like rib-knitting also formed at the breast portion designated by reference numeral A, wide pitched vertical convexities like rib-knitting at the portion B near the bottom portion thereof and plaits formed at the bottom portion. The sleeves also have thin convexities and concavities like rib-knitting similar to the breast A.

Upon manufacture of this garment, cloths 6 to be pattern is previously attached and fixed to the cloth 1 to be the front body part. The cloths 6 preferably have adhesive on one side thereof, such as fusible interlining, and it is thermally fixed to the cloth of the front body part so as to form pattern. In order to secure fixing, it is preferred that its peripheries are fixed by means of a sewing machine. The pattern cloths 6 are also a cloth made of thermoplastic fiber such as polyester.

Figure 10:
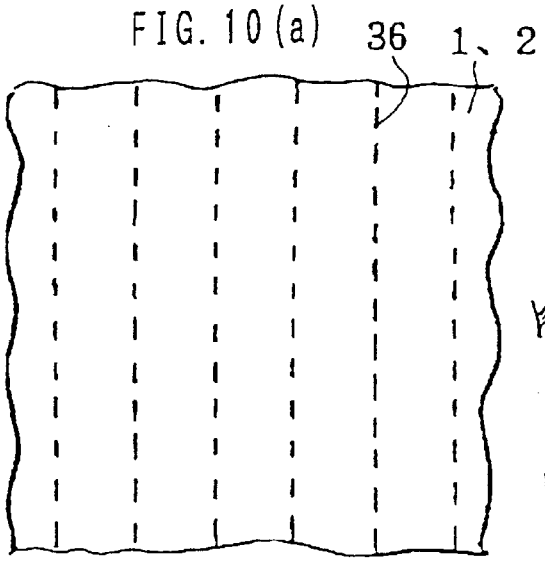
FIG. 10 shows steps for forming convexities and concavities like as rib-knitting wherein FIG. 10(*a*) is a plan view of the sewn cloth, FIG. 10(*b*) an enlarged perspective view showing the sewing method, FIG. 10(*c*) is a plan view schematically showing the rib-knitting like pattern in the cloth for the obtained garment, FIG. 10(*d*) is a cross sectional view schematically showing the rib-knitting like pattern in the cloth for the obtained garment.
Figure 10:
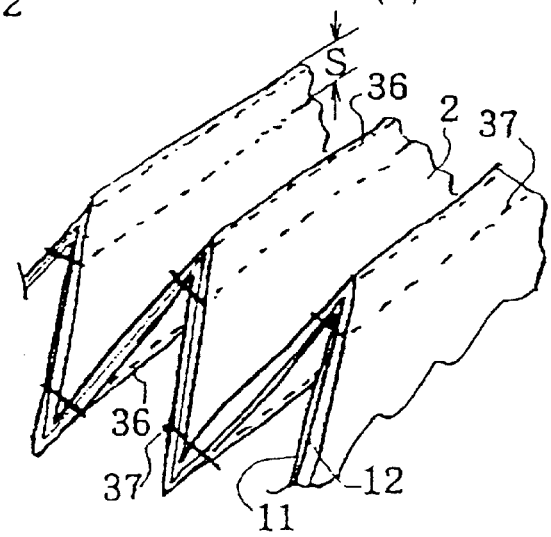
Figure 10:
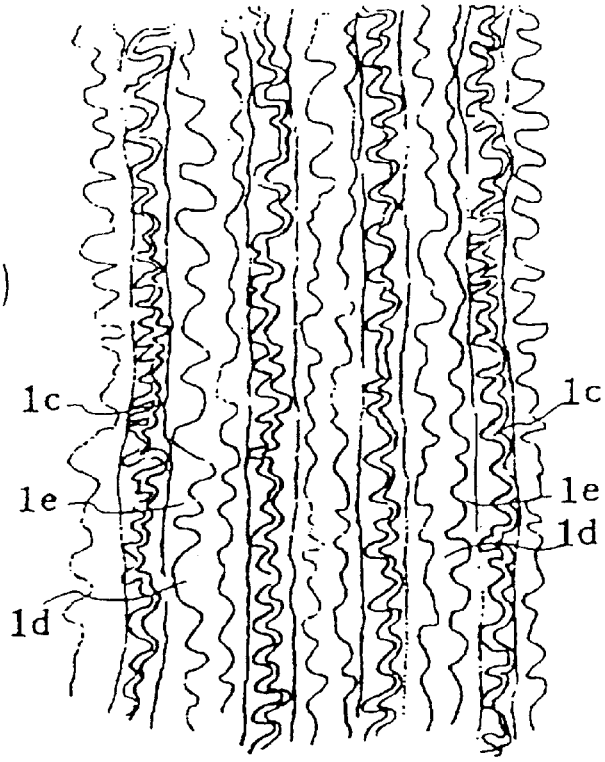
Figure 10:
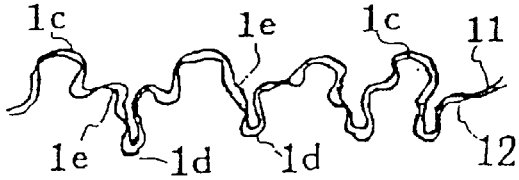

In order to form convexities and concavities like rib-knitting, the following operation is carried out. First, as illustrated in FIG. 10(*a*), the cloths 1 of the front body part 11, the back body part 12 and sleeves are sewn in a shape of garment, and they are overlaid on Teviron cloth so that Teviron cloth becomes in contact with the side of the back body part 12. Under this condition, as illustrated in FIG. 10(*a*), rows of stitches are formed with a water-soluble thread 3 at a predetermined pitch. In an actual embodiment, rows of stitches were made at 10 mm pitch at the portion corresponding to portion A, and rows of stitches were made at 20 mm pitch at the portion corresponding to portion B. Then, as illustrated in FIG. 10(*b*), the cloths are picked up at the rows of previously sewn stitches 36 and tuck stitches 37 are sewn with water-soluble threads 3 while they are tucked. In this occasion, the distance between the row of stitches 36 in portion A and the tuck stitch 37, i.e., the tucking width s, is set at 1 mm, and in portion B, the tucking width is set at 5 mm. In this occasion, as illustrated in FIG. 10(*b*), every other row of stitches 36 is picked up toward the side of Teviron cloth and tuck stitches 37 are sewn, and after the cloths are turned over, every other row of stitches 36 is picked up toward the front side, i.e., toward the front body part, and tuck stitch 37 is sewn. After tuck stitches 37 are sewn as described above, the overlaid cloths 1 and 2 form a zigzag cross section as a whole. Under this condition, they are heated for 70 sec. at 190° C. and heat set so as to contract the Teviron cloth. Then, the water-soluble threads, i.e., Solvron thread, used for the stitches 36 and the stitches 37 are solved, the Teviron cloth is peeled off from the front body part 11 and the back body part 12 of the garment, thus, the garment as illustrated in FIG. 9(*a*) was obtained.

Although in the above-described embodiment, the stitches 36 and 37 were sewn after the sleeves had been attached to the body parts, the body parts and the sleeves may be treated separately and they may be combined later. In this embodiment, tuck stitches are sewn at a distance of 1 mm from the end, which are created by folding along the stitches 36. Stitch sewn at position within 1 to 3 mm from an end is usually called "end stitch", the expression "sew end stitch" in the following embodiment means that the tuck stitch is so sewn that the tucking width is within range of between 1 to 3 mm.

FIG. 10(*c*) is a plan view schematically showing the rib-knitting like pattern, and FIG. 10(*d*) is a cross sectional view schematically showing the rib-knitting like pattern. When seen from the side of the front body part, as illustrated in FIG. 10(*c*), the rib-knitting like pattern has narrow stripe shaped convexities 1*c* and/or concavities 1*e* and 1*d* alternately formed as rib-knitting. As illustrated in FIG. 10(*d*), the convexities 1*c* which have not been in contact with Teviron cloth are gentle, while the convexities, which have been in contact with and sewn with Teviron cloth and which are concavities when they are seen from the side of the front body part, become sharp. Between the convexities 1*c* and 1*d*. there are intermediate convexities and concavities 1*e*. As described above, the convexities and/or concavities formed by tuck are remarkably clear compared with those formed by a single row of stitches.

As described above, the cloths 1 of garment have stripe-shaped convexities or concavities, and although it is not illustrated in FIGS. 10(*c*) and (*d*), the cloths 1 have/series of needle holes formed therein as traces of the stitches 36 and 37 sewn with water-soluble threads. More specifically, series of needle holes extend in a longitudinal direction at the top of a convexities or the bottom of a concavities as a trace of the stitches 36. Two series of needle holes extend in a longitudinal direction in parallel with the above-described series of needle holes at both sides of the above-described series of needle holes as a trace of the stitches 37. The letter series of needle holes locate at the base portion or intermediate portion of the convexities or concavities. The convexities or concavities formed by the stitches 36 and tuck stitches 37 has small pleats or convexities and/or concavities formed thereon since the cloth 1 has been heated and contracted while it has been secured to the thermo-shrinkable cloth by means of the stitches 36 and tuck stitches 37.

According to the embodiments illustrated in FIGS. 9 and 10, the finished garment has convexities and concavities like as rib-knitting as illustrated in FIG. 10(*d*), and due to formation of the convexities and concavities in a longitudinal direction, the garment contracts great in a widthwise direction. In addition to the shrinkage percentage of the Teviron cloth, influence due to tuck also appears, and thus, as a whole contraction in the widthwise direction becomes larger than that in the longitudinal direction. Accordingly, upon cutting first, the size in the widthwise direction is set 2.7 to 2.8 times as large as that of the final garment because it contracts great in the widthwise direction. The garment may contract in the longitudinal direction together with the contraction of the Teviron cloth, the longitudinal size was set about 1.4 times as large as that of the final garment according to this embodiment.

Upon tucking, the cloths may be folded at the stitches 36 which have been sewn previously as the center of tucking and picked up, and stitches 37 may be sewn in an ordinary manner along the folded end by means of a usual sewing machine. However, tucks can be sewn by means of a sewing machine for forming various decorative stitching. In this occasion, in such a sewing machine, two needles forms stitches of needle threads while a bobbin thread is sewn in a zigzag manner between the two needle threads. When the tension in the bobbin thread is raised, the stitches between the two needle threads are brought near to form tuck condition. As described above, using a sewing machine for forming various decorative stitching, tuck can be formed readily. In this occasion, the sewing machine for forming various decorative stitching sews stitches in such manner that the stitches 36 for the center of tucking which have been sewn previously locate between the two rows of stitches.

Figure 11:
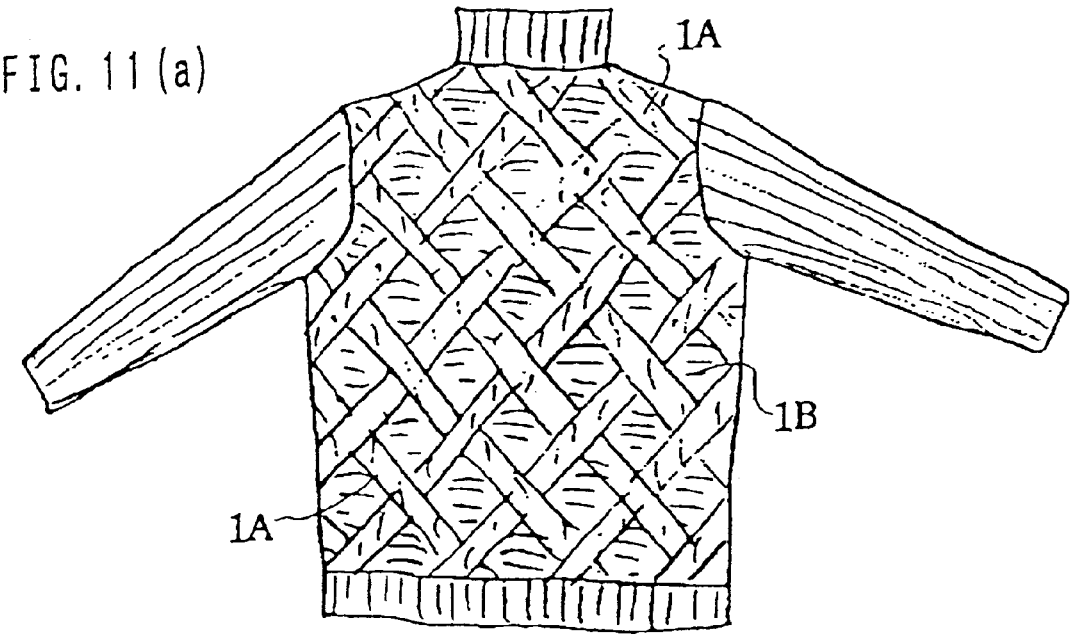
FIG. 11 shows still another embodiment of the present invention, wherein FIG. 11(*a*) is a plan view showing the manufactured garment, and FIG. 11(*b*) is a view of the pattern for forming the front body part of the garment illustrated in FIG. 11(*a*)
Figure 11:
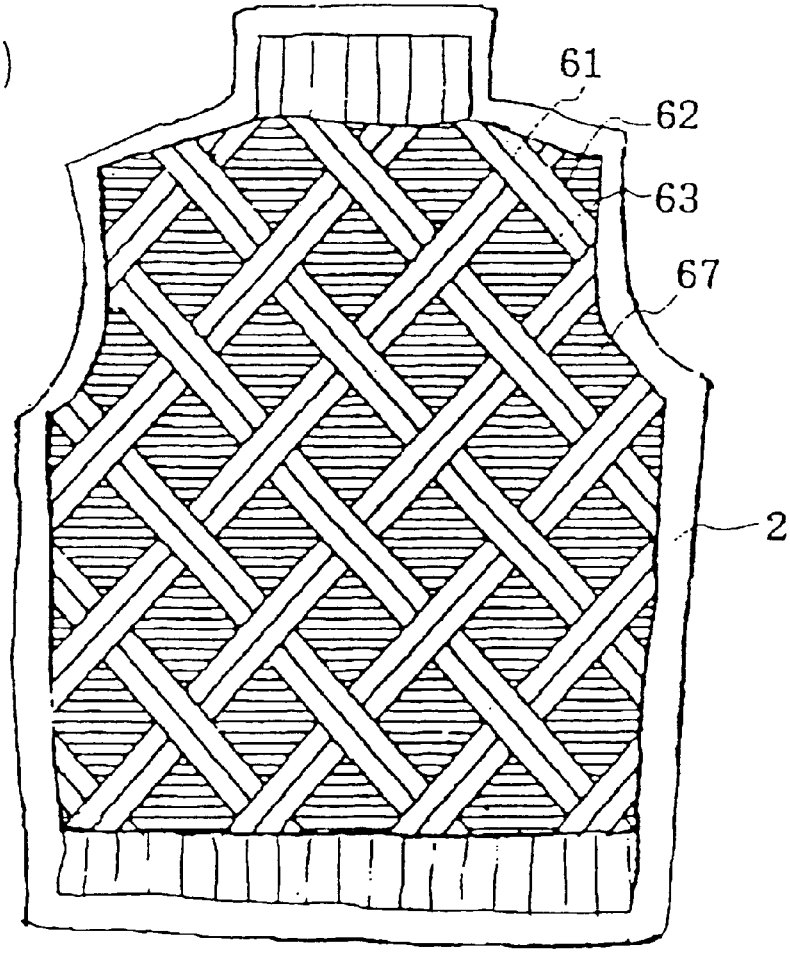

FIG. 11 shows another embodiment of the present invention, wherein FIG. 11(*a*) is a plan view showing the manufactured garment. The garment has widely protruding convexities 1A with an argyle check like pattern (oblique cross stripes) at the side of the front body part, and small convexities and/or concavities 1B formed within the argyle regions surrounded by the convexities. In the garment illustrated in FIG. 11(*a*), rib-knitting like pattern having convexities and concavities similar to the above-described ones are formed at the sleeves, neck portion and the bottom portion. The rib-knitting like portion can be formed in a manner similar to that explained with reference to the above-described embodiment, wherein parallel rows, having a distance of 7 to 10 mm therebetween, are sewn, and while picking up and tucking at the rows of stitches, tuck stitches are sewn by means of sewing machines.

Figure 12:
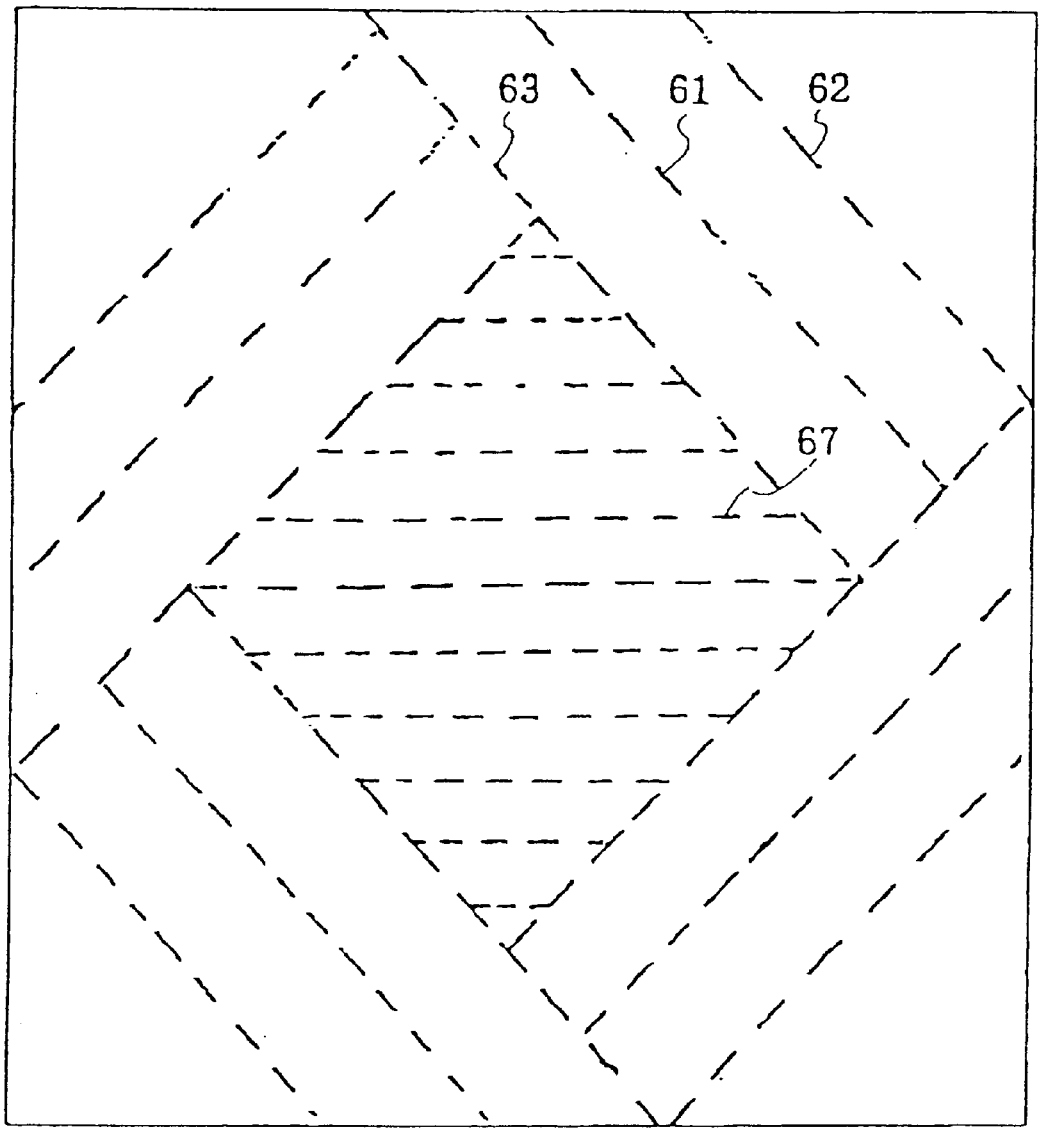
FIG. 12 is an enlarged view showing the method for sewing the cross stripes of the garment illustrated in FIG. 11, wherein FIG. 12(*a*) is a plan view, and FIG. 12(*b*) is a view taken along the cross section and showing the sewing method.
Figure 12:
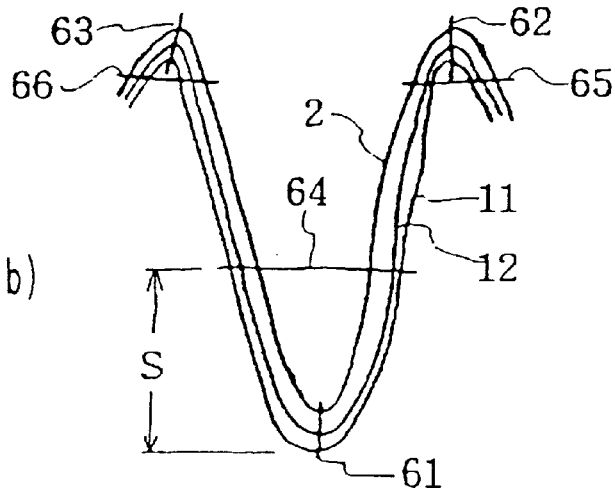

FIG. 11(*b*) is a view of the pattern for forming the front body part of the garment illustrated in FIG. 11(*a*). The front body part and the back body part are sewn together, and further, Teviron cloth 2 is overlaid on the back body part, and then the pattern illustrated in FIG. 11(*b*) is transcribed on the Teviron cloth. And then, the front and back body parts and the Teviron cloth are sewn by water-soluble threads 3 along the transcribed pattern. FIG. 12 is an enlarged view showing the method for sewing the cross stripes of the garment illustrated in FIG. 11, wherein FIG. 12(*a*) is a plan view, and FIG. 12(*b*) is a view taken along the cross section and showing the sewing method.

As illustrated in FIG. 12(*a*), three rows of stitches 61, 62 and 63 are sewn with water-soluble threads, by means of a sewing machine, for the cross stripes, and rows of stitches 67 are sewn at area surrounded by the cross stripes. A wide convexities 1A is created as follows. As illustrated in FIG. 12(*b*), after the stitches 61, 62 and 63 are sewn, the clothes are picked up toward the front body part 11 (opposite to the Teviron cloth 2) around the stitches 61 by a tucking width S of 10 mm, which stitches have been sewn at the center, and tuck stitches 64 are sewn with a water-soluble thread. The portions of the clothes at the stitches 62 and 63 are picked up toward the back, and end stitches 65 and 66 are sewn with water-soluble threads spacing about 1 to 2 mm from the stitches 62 and 63, respectively. The distance between the rows of stitches 61 and 62 and the distance between the rows of the stitches 61 and 63 ware 15 mm in this embodiment. The portion of the diamond pattern has stitches 67 sewn at a pitch of 8 mm. The rib-knitting like portions having convexities-or ridges and concavities or grooves are obtained by sewing stitches at 8 mm pitch with water-soluble threads and further by sewing end stitches with water-soluble threads alternately picking up toward the front side and the back side.

After the stitches are sewn as described above, the cloths are subjected to heating treatments twice, in each of which they are heated 2 minutes at between 140 and 160° C. so as to heat set the cloths, and then the water-soluble threads, Solvron thread in this embodiment, sewn as stitches are solved and removed in hot water, Thus, the body parts as illustrated in FIG. 11 are obtained. In this occasion, wide stripe portion 1A is formed by the stitches 61 to 66 and large wide convexities bulge toward the front side. Small convexities and/or concavities are formed within the diamond pattern.

Figure 13:
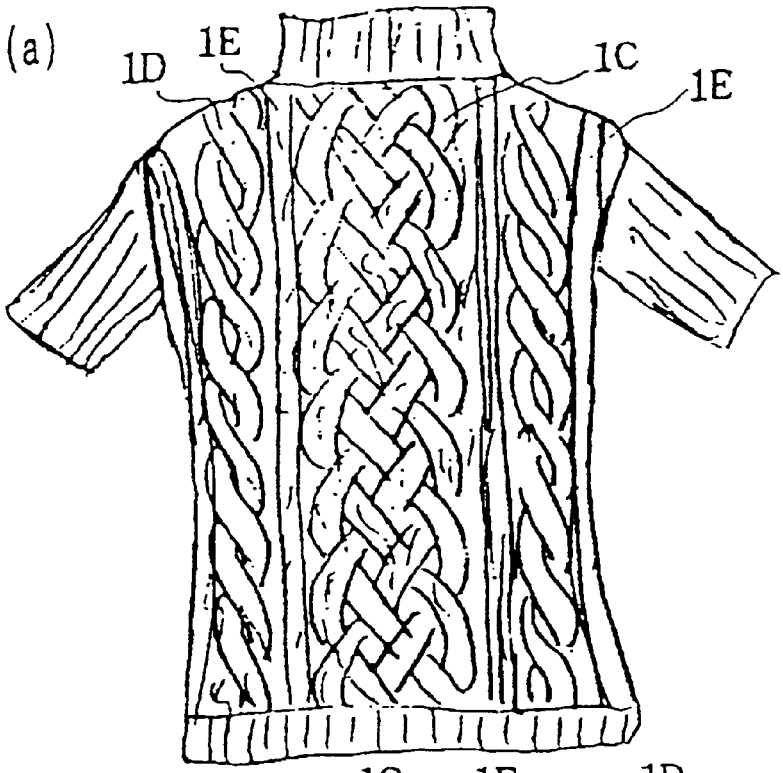
FIG. 13 shows still another embodiment of the present invention, wherein FIG. 13(*a*) is a plan view of the garment manufactured according to the present invention, and FIG. 13(*b*) is a pattern view for forming the front body part of the garment illustrated in FIG. 13(*a*)
Figure 13:
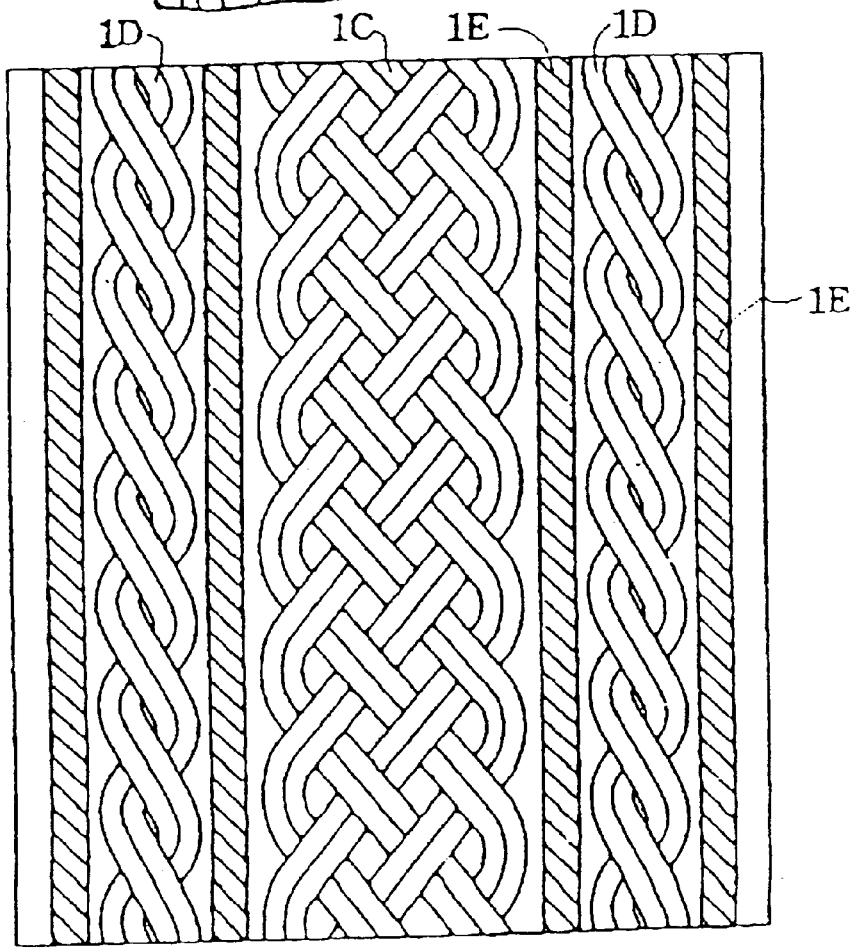

FIG. 13 shows another embodiment of the present invention. FIG. 13(*a*) is a plan view of the garment manufactured according to the present invention. As illustrated in FIG. 13(*a*), the garment has wide bulged rope knitting like patterns 1C and 1D formed in the front body part. Further, the garment has wide bulged stripes 1E extending in a vertical direction formed between the cable-stitch pattern 1C and the rope knitting like pattern 1D. Rib-knitting like portion similar to the above-described one is formed at the sleeves, neck portion and the bottom portion.

The rope knitting is formed by using polyester cloth, Teviron cloth and Solvron threads, i.e., water-soluble threads. Provisional test was done to examine how much the portion of rope knitting like patterns will contract, and it was confirmed that it contract 71.5% in a longitudinal direction and 62.5% in a widthwise direction. Taking this result into consideration, upon cutting a cloth or cloths of garment, the cloth is cut at size of 1.4 times in the longitudinal direction and size of 1.6 times in the widthwise direction as large as the desired finish size.

Figure 14:
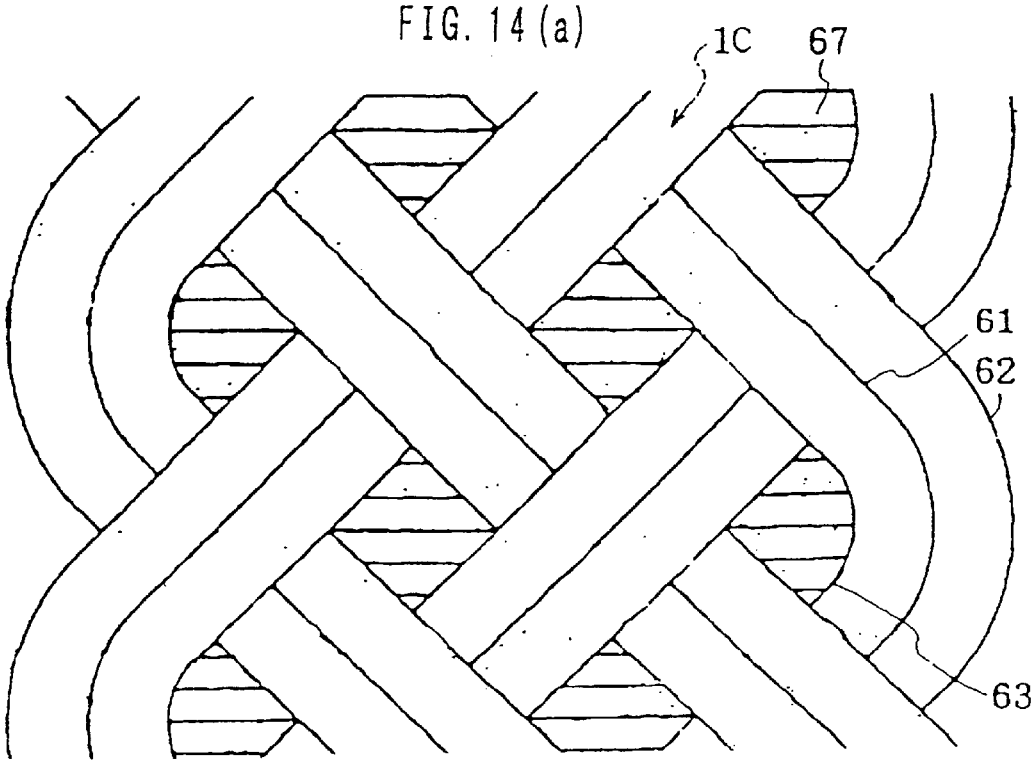
FIGS. 14(*a*) and (*b*) are plan views for explaining the stitching method for forming the rope knitting pattern such as illustrated in FIG. 13(*a*), and FIG. 14(*c*) is a cross sectional view showing the sewing method.
Figure 14:
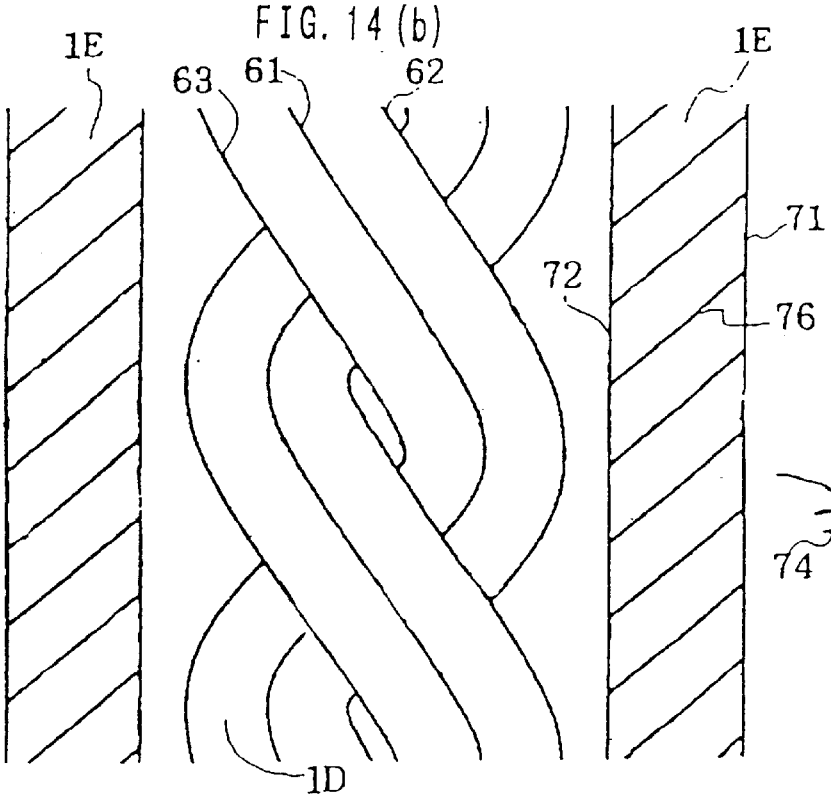
Figure 14:
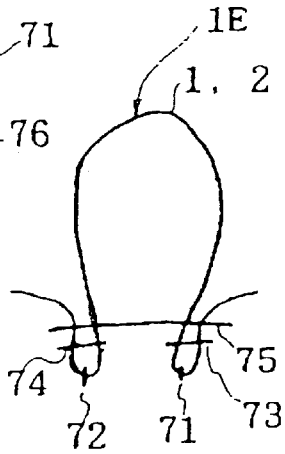

FIG. 14 is a plan view for explaining the stitch forming method for forming the rope knitting like pattern such as illustrated in FIG. 13(*a*). Teviron cloth 2 is overlaid on the cloths 1 of garment, and then the pattern illustrated in FIG. 13(*b*) is drawn on the Teviron cloth 2. The detailed constructions of the rope knitting like portions 1C and 1D are illustrated in FIGS. 14(*a*) and (*b*), respectively. In an actually manufactured garment, at the wide rope knitting like portion as illustrated in FIG. 13(*a*), one rope knitting like portion is formed by a combination of three rows of stitches and tuck stitches around these stitches. This construction is similar to the embodiment explained above with reference to FIG. 12. More specifically, In FIG. 14(*a*), the distance between the central stitches 61 and the outer stitches 62 or 63 is 1.5 cm. After these stitches 61, 62 and 63 are sewn, the cloths 1 and 2 are picked up at the central stitches 61 toward the front side, which is opposite to the Teviron cloth 2, by a tucking width of 7 mm, and tuck stitches are sewn with a water-soluble thread. The portions of the cloths at the stitches 62 and 63 are picked up toward the back, and end stitches are sewn with water-soluble threads. At the portion of the diamond pattern formed between the rope knitting like patterns, there are only stitches 67 sewn first at a pitch of 5 mm but not tuck stitches.

The rope knitting like portion 1D and the vertical wide convexities 1E formed at the sides will now be explained with reference to FIG. 14(*b*). The wide lines in the rope knitting like portion 1D are formed in a manner similar to that for stitches 61, 62 and 63 as explained with reference to FIG. 14(*a*), and after the central stitches are sewn, the cloths are picked up at the width of 5 mm from the front side and tuck stitches are sewn. With regard to the stitches 62 and 63, end stitches are sewn while the cloths are picked up reversely.

The wide convexities 1E extending in a vertical direction are formed in a manner which will be described below. Stitches 71, 72 and 76 are sewn with water-soluble threads. As illustrated in FIG. 14(*c*), the stitches 71 and 72 are picked up in a reverse direction, and end stitches 73 and 74 are sewn with water-soluble threads. The oblique stitches 76 remain as they are since no tucks are formed there. As illustrated in FIG. 14(*c*), the portions where the vertical side stitches 71 and 72 were sewn are gathered, picked up toward the front side, and tuck stitches 75 are sewn with a water-soluble thread to form tuck. Although the cloths are illustrated by a single line in FIG. 14(*c*) only for explanation of tucking method, however, it should be noted that the line designates the overlaid Teviron cloth 2 and cloths 1 of a garment. The cloths stitched as described above are heat set in a manner similar to that described above. In this case, the heat set is done at a temperature of between 140 and 170° C. for between 60 and 70 sec.

It is preferred that the heat set time is somewhat prolonged when cloths of a garment is relatively thick. Then, the water-soluble threads 3 used for the stitches are solved and removed, and the Teviron cloth is peeled off from the garment 1.

The product thus manufactured was like that illustrated in FIG. 13(*a*), wherein wide ridges like as rope knitting like patterns and wide vertical stripes can be seen. The wide vertical stripes are wide ridges having convexities and/or concavities bulged on the surface thereof as trace of the stitches sewn obliquely. Although the sleeves, neck portion and the bottom portion have convexities and/or concavities like as rib-knitting, their explanation is omitted here.

Figure 15:
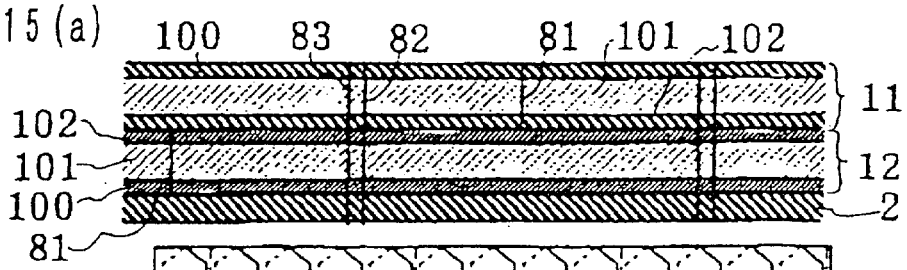
FIG. 15 shows still another embodiment of the present invention, wherein FIG. 15(*a*) is a cross sectional view of cloths showing the sewing method, FIG. 15(*b*) is a plan view of the sewn cloths, FIG. 15(*c*) is a cross sectional view of the obtained cloth at the pattern portion, and FIG. 15(*d*) is an enlarged plan view of the obtained cloth at the pattern portion.
Figure 15:
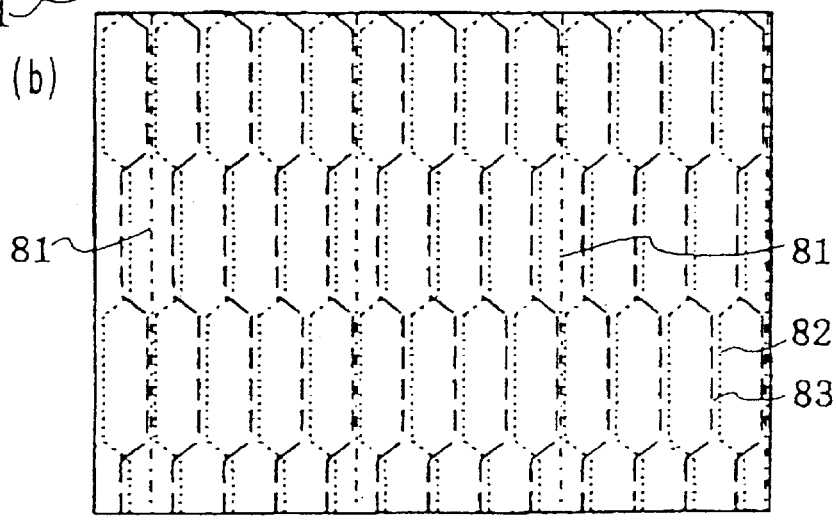
Figure 15:
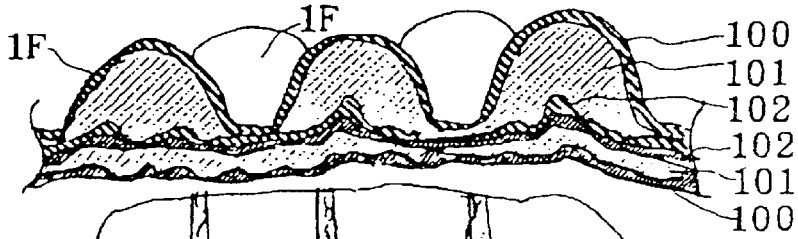
Figure 15:
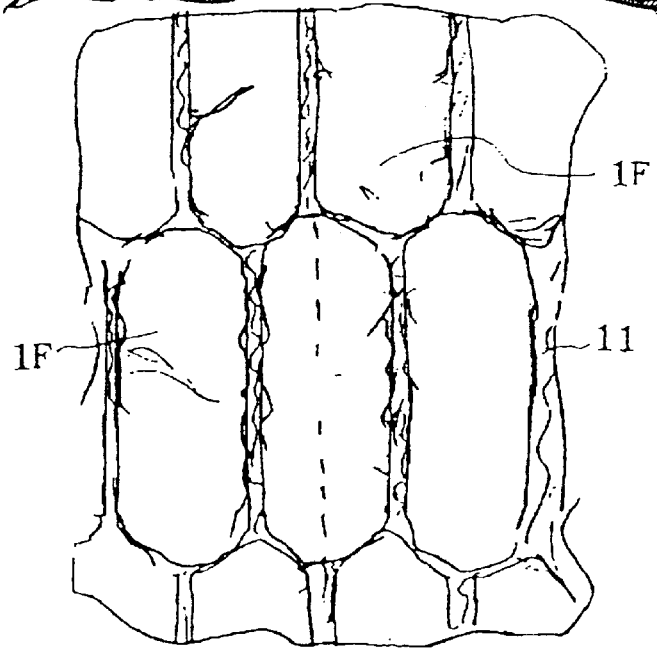

FIG. 15 shows still another embodiment of the present invention, and it shows a sewing method wherein filler is filled to increase the thickness of cloths for a garment. First, the filler 101 is filled between a cloth 100 for right side including thermoplastic fiber and a cloth 102 for lining including thermoplastic fiber, and under this condition, quilting stitch 81 is sewn with water-insoluble threads. The filler 101 preferably comprises thermoplastic fibers, for example, polyester staple fiber. The quilted cloth(s) is cut in a shape of the garment, and the front body part 11 is overlaid on the back body part 12 in such a manner that their lining surfaces are contacting with to each other, and Teviron cloth 2 is overlaid on the side of the back body part. Under the overlaid condition, as illustrated in, for example, FIG. 15(*b*), stitches are sewn in an vertically elongated tortoise shell pattern. In the stitches, two rows of stitches make a set, stitches 82 and 83 make a set. At the portion of the vertical tortoise pattern, the stitches 82 and 83 are sewn in parallel forming narrow distance therebetween. The narrow distance is for example between 2 and 8 mm, and a distance between adjacent two sets of rows of stitches 82 and 83 is wide, and it is at lest three times, about five times in the illustrated embodiment, as large as the narrow distance. Thus, a plurality of sets of stitches are sewn. Under this condition, they are heated so as to contract Teviron cloth 2, and then, the Solvron thread forming the stitches 82 and 83 are solved and removed. The quilting stitches 81 are sewn with usual threads but not water-soluble threads.

Thus, as illustrated in FIG. 15(*c*), cloths bulged toward the front side is obtained. FIG. 15(*d*) is a plan view seen from the front surface, wherein the portion sewn with two lines is depressed and the portion surrounded by the two lines forms a projection 1F in a track shaped pattern. Contrary to this, the back side dose not project great since it has been in contact with Teviron cloth, and although it has some convexities and/or concavities, it dose not bulge so much as the front side, and accordingly, it is as a whole somewhat flat. Consequently. when the front body part 11 and the back body part 12 are sewn together, the front body part 11 and the back body part 12 have different appearances, and an amusing garment can be obtained.

When it is required to form large bulges on both the front body part and the back body part, the front body part 11 and the back body part 12 are separated and individually overlaid on a Teviron cloth 2, and then, they are overlaid in such manner that their front surfaces 100 face outside while their linings 102 are in contact with the Teviron cloth 2, and stitiches are sewn with water-soluble thread made of Solvron thread in a above-described manner. After largely bulged projections are formed, they are sewn to each other using them as the front body part and the back body part, and thus a garment having the same pattern on both the front and back body parts can be obtained.

In this case, when the garment illustrated in FIG. 15(*b*) was actually manufactured, the shrinkage percentage was 75% in the longitudinal direction and 80% in the widthwise direction. Accordingly, taking the shrinkage percentage into consideration, it is preferred to prepare a pattern paper of the garment which is enlarged 1.3 times in the longitudinal direction and 1.25 times in the widthwise direction in relation with the size of the finished garment.

Figure 16:
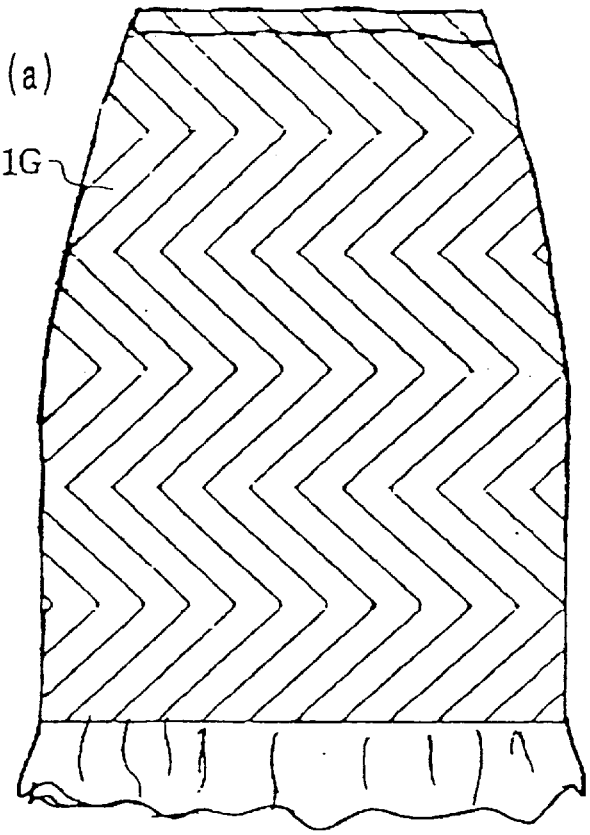
FIG. 16 shows another embodiment of the present invention, wherein FIG. 16(*a*) is a plan view of the obtained skirt, FIG. 16(*b*) shows pattern to be transferred to the cloth of Teviron cloth, and FIG. 16(*b*) is a view showing the sewing method.
Figure 16:
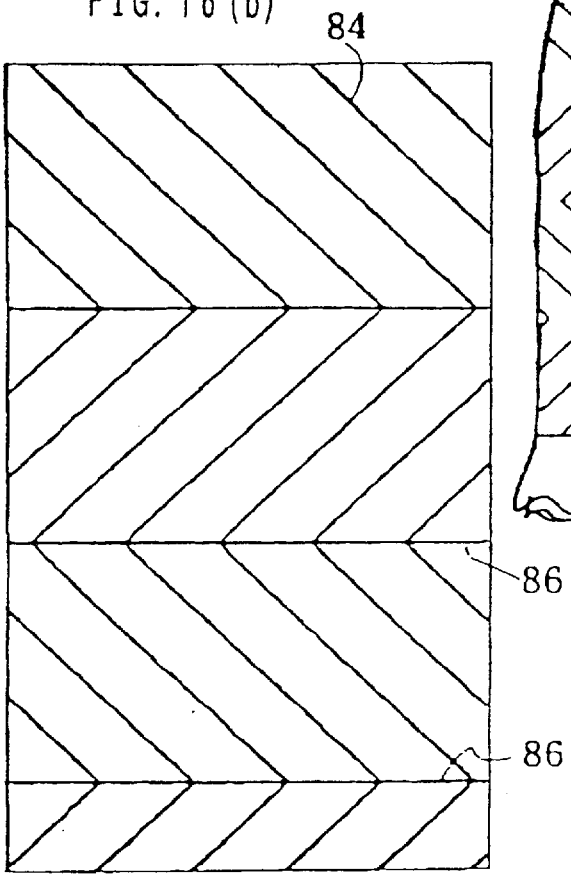
Figure 16:
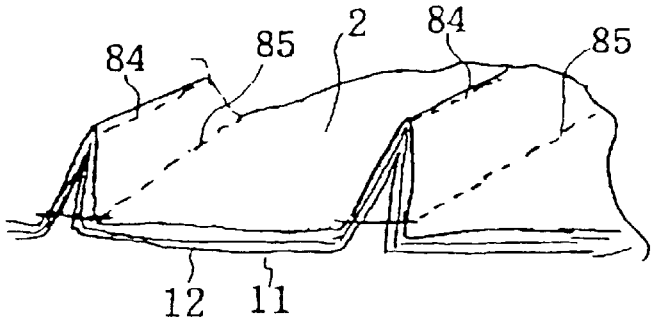

FIG. 16 shows the other embodiment of the present invention, wherein FIG. 16(*a*) is a plan view of the obtained skirt. For the skirt of this embodiment, velvet is used for cloths of the garment. As illustrated in FIG. 16(*a*), convexities 1G appear in a zigzag form, and the bottom portion is pleated.

In order to make such product, the velvet cloths as formed in the skirt are overlaid on Teviron cloth 2. The Teviron cloth is placed on the side of the back part 12 of the skirt. The pattern illustrated on FIG. 16(*b*) is drawn on the Teviron cloth. Stitches 84 and 86 are sewn with water soluble threads 3 except for the bottom portion as illustrated on FIG. 16(*b*). While the stitches 86 in the widthwise direction are remained as they are, only the oblique stitches 84 are picked up toward the Teviron cloth side with a tucking width of 3 mm, and tuck stitches 85 are sewn. In this case, sewing of the tuck stitches 85 is stopped just before they cross the straight stitches 86. FIG. 16(*b*) is a view showing the method for picking up the velvet. More specifically, it shows the portion where the oblique stitches 84 are sewn while they are picked up toward the Teviron cloth 2. After sewn as described above, the sewn cloths are heated for 2 minutes at a heating temperature of 160° C., and after a certain interval of time, they are heated again for 2 minutes. Thereafter, the water-soluble thread 3 is solved and removed, and the Teviron cloth is peeled off.

In the obtained product, as illustrated in FIG. 16(*a*), no widthwise line can be seen, and the boundaries are depressed, and zigzag forms are bulged. In this case, since the velvet cloth is thick, the contracted condition is not remarkable at the porion of the widthwise stitches 86, and contrary to this, tucked portions are depressed, and the pattern clearly appears.

Figure 17:
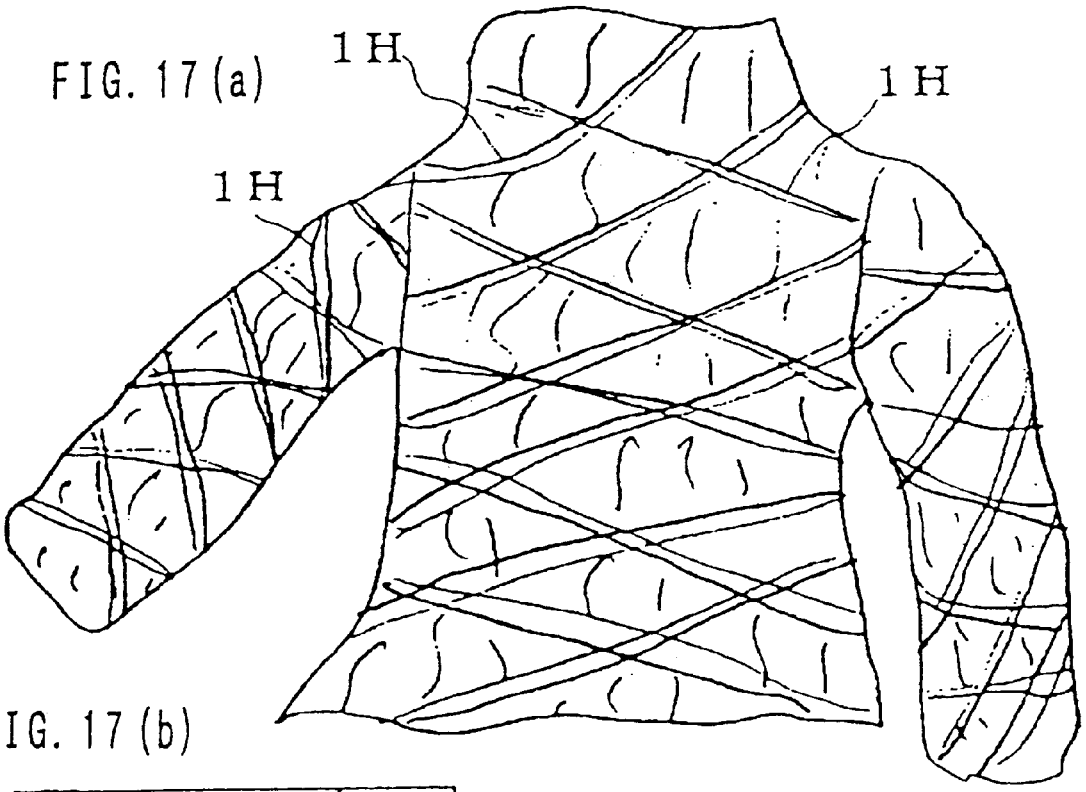
FIG. 17 shows still another embodiment, FIG. 17(*a*) is a plan view of the finished article, FIG. 17(*b*) is a plan view of the stitches, FIG. 17(*c*) a cross sectional view showing the sewing method, and FIG. 17(*d*) is a schematic view of the pattern.
Figure 17:
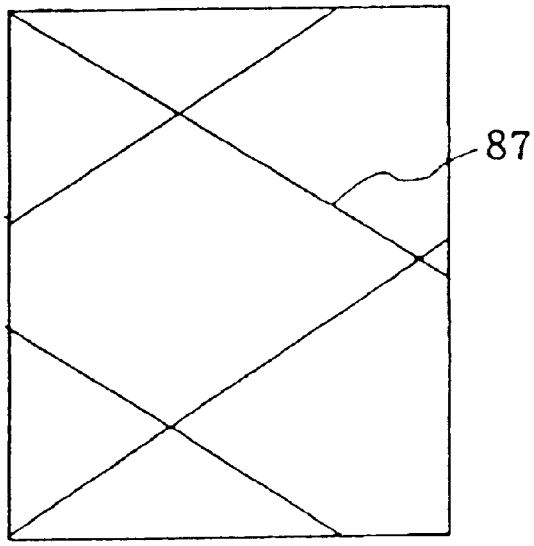
Figure 17:
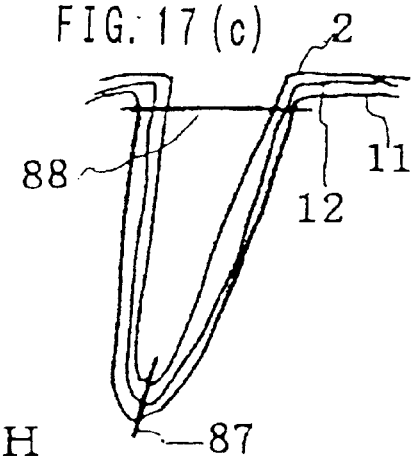
Figure 17:
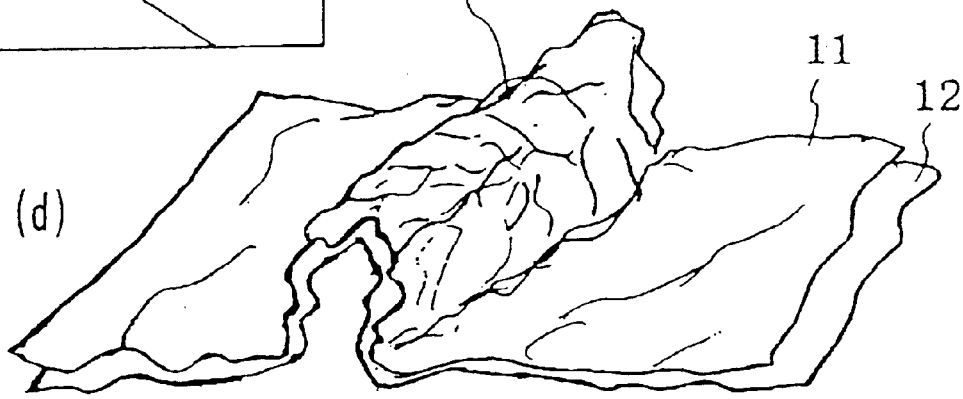

FIG. 17 shows still another embodiment. FIG. 17(*a*) is a plan view of the finished article, wherein cloths are thin taffeta made of polyester. As illustrated in FIG. 17(*a*), crossed large oblique projections 1H are formed on the thin cloths, and large plaits are formed between the cable-like projections 1H. Upon manufacture of this garment, the cloth is cut into parts of the garment, and the parts are sewn in a shape of the garment, and while they are overlaid on Teviron cloth 2, crossed oblique stitches 87 are sewn at a big pitch as illustrated in FIG. 17(*b*) with water-soluble threads 3. Then, the cloths are picked up at the stitches 87, the tucking width in this case is about 1.5 cm, which is larger than that in the above-described embodiments. Stitches 88 are sewn with water-soluble thread while the stitches are always picked up toward the front body part 11. The thus obtained cloths are heated and then the water-soluble threads 3 is solved and removed. Thus, big projections 1H as illustrated in FIG. 17(*d*) are formed. FIG. 17(*d*) shows a condition wherein the front body part 11 is overlaid on the back body part 12. As it will be seen from FIG. 17(*d*), the big projection 1H appears at the front surface while the back body part 12 has depression corresponding to the big projection.

In all the above-explained embodiments, the cloth is sewn in a shape of a garment or is sewn in a part of the shape of the garment, and it is sewn with Solvron thread while it is overlaid on Teviron cloth. However, the following method is also applicable.

After cloth which has been cut in a shape of the garment but not sewn in the shape of the garment, is sewn together with Teviron cloth with water-soluble threads, it is heated, and the water-soluble threads are solved and removed so that cloth having convexities and/or concavities developed thereon is obtained. Then, the cloth may be sewn into the garment.

Alternatively, only cloth may be sewn together with Teviron cloth with water-soluble threads so as to form convexities and/or concavities. The treatment of the present invention may be carried out for a cloth, especially when a desired pattern is drawn on the Teviron cloth, and when stitches are sewn with water-soluble threads along the pattern, and further, when the cloth is picked up around the desired portion of the stitched portions and tuck stitches are sewn. More specifically, since big convexities and/or concavities may be formed when crinkle forming operation is done under a tucked condition compared with the case wherein the stitches are formed under a flat condition, difference in the patterns width convexities and concavities in the front body part and the back body part becomes clear when the treatment is done while front body part and the back body part are overlaid. Because of this, when it is required to form the similar crinkled pattern on the front body part and the back body part, without sewing the front body part and the back body part, the cloth of the garment, which is in a condition of a single piece, is sewn together with the Teviron cloth with water-soluble threads, and then it is heated and the water-soluble threads is solved and removed. Thus, the same pattern can be formed on both the front body part and the back body part. In this case, when the pattern is relatively simple, the convexities and/or concavities may be formed in a cloth before cutting it into parts of a garment. However, when a predetermined convexities and/or concavities has to be positioned at a predetermined portions of the garment from design point of view, it is preferred to form convexities and/or concavities in a cloth after cutting it in a shape of the garment. Thus, the garment of desired design can be obtained easily.

When rib-knitting like article is produced, if the treatment is done in a cloth condition, tucking has to be done alternately from the front side and the back side. Therefore, it is easy to perform the treatment with short cloth within some meters rather than with a long cloth.

The tucking according to the present invention is done with one row of stitches at the central portion of a tuck and tuck stitches locating both sides of the central stitches, such a central stitches being not in existence in an ordinary pin-tuck. In order to produce a rib-stitch like article, a plurality rows of the central stitches may be sewn first at a predetermined pitch, and for example, every other rows of central stitches may be picked up toward the front side and tuck stitches are sewn, and then turning over the cloths, tuck stitches may be sewn while picking up at the remaining rows of the central stitches.

When large plaits are required, gathers are formed previously with a sewing machine for gathering, and then, it is sewn with Teviron cloth. Thus, large convexities and/or concavities which are larger than those created by only contraction of the Teviron cloth can be formed. The gathering and sewing with Teviron cloth may be performed simultaneously by means of a sewing machine for gathering. In this case, both the stitches for gathering and the stitches for sewing may be done with water-soluble thread.

As described above, according to the present invention, stitches can be sewn in any optional pattern, and the distance between the rows of the stitches may be widen or narrowed. Accordingly, convexities and/or concavities in the obtained cloth 1 may be various.

Further, convexities and/or concavities of the present invention can be formed at any desired portions in a garment. In this case, it is possible to form the convexities and/or concavities on both the front side and the back side at the same time, or when the garment is opened at the front, it is possible to form convexities and/or concavities only in the front body part or the back body part, or to form convexities and/or concavities at the front lapped portions and the center portion of the back body part simultaneously by folding the garment at the center of the front part in such a manner that sleeves are superimposed on each other and sewing stitches after overlaying thermoplastic cloth 2 on the front lapped portions.

In the above-describe explanation, the thermoplastic cloth 2 is overlaid on the garment and the stitches are sewn on them. however, the thermoplastic cloth 2 may be inserted between the cloths 1 of garment, for example between the front body part and the back body part, and they may be sewn together.

According to the present invention, when the cloth(s) of a garment is cut and is sewn in a shape of the garment, the contracting ratio is confirmed previously through an experience, and the cutting and sewing are done based on the result of the experience so that the desired size can be obtained. In other word, even when the same cloth 2 is used as a thermo-shrinkable cloth 2 and is sewn in the same manner, the cloths of garment will contract remarkably when it is thin, while it will not contract remarkably nor form big convexities and/or concavities due to the force in the cloth of garment when it is thick such as velvet.

The cloths of garment according to the present invention has to be a thermoplastic fiber so as to be heat set. As long as the cloth has such a property, the cloths constructing one garment may be one kind or at least two kinds with respect to its color or material. For example, two kinds of tape-like cloths, which are different in their colors, are sewn together to form a large single cloth, and it may be cut into parts of a garment so as to use as a cloth including thermoplastic fiber of the present invention. Alternatively, for example, when each body part comprises a plurality of pieces of cloths, pattern papers which correspond to the divided body parts are previously prepared, and a plurality of cloths which are different in their colors or shape are cut along such divided pattern paper and are sewn in a body part, and thus obtained body part may be used as a cloth including thermoplastic fiber of the present invention. Further, when convexities and/or concavities are formed using a cloth obtained by sewing a see-through cloth with a non-see-through cloth as a cloth including thermoplastic fiber of the present invention, the obtained garment is very amusing both from a design point of view and from aesthetic point of view due to synergistic effects of the see-through effect and the effect of the convexities and/or concavities.

As mentioned above, according to the method of the present invention, convexities and/or concavities can be formed at almost entire portions of the garment or any desired portion of the garment without any substantial limitation from a design point of view.

Further, according to the method of the present invention, when convexities and/or concavities are formed at almost entire portions of a garment or any desired portion of the garment using cloth which is thermo-shrinkable in both the weft and warp directions, the garment having convexities and/or concavities therein can be manufactured, which is capable of being expanded and contracted in both the length and breath directions like knitted article. More specifically, when stitches are sewn on the cloths of garment and the thermo-shrinkable cloth, if the stitches are sewn on almost entire portions of the garment, entire portions of the garment may be expanded and contracted. Since the garment has convexities and/or concavities at entire portions and since it can expand and contract in length and breadth directions, product having high shrinkability like a knitted fabric can be obtained. Further, when convexities and/or concavities are formed at the breast, the breast has high expansion. Accordingly, a garment which fits the body well can be obtained without forming any special darts.

Further, when convexities and/or concavities are formed at entire portions of the garment or any desired portion of the garment using a cloth which is thermo-shrinkable in either warp or weft direction, the garment which can be expanded and contracted in either warp or weft direction can be obtained and is easy to wear as a blouse, slackes, etc.

When convexities and/or concavities are formed according to the method of the present invention, it is not limited from design different from the formation of knitted fabric, and it is not limited from the directional property which is inherent to a conventional pleating, and thus, variety of design spreads out widely. When stitches are sewn in various curves, curved projections and depressions can be obtained, and thus design becomes very amusing.

According to the method of the present invention, after convexities and/or concavities are formed in the cloths, a pattern may be printed while the cloths has convexities and/or concavities. Accordingly, when the obtained garment is worn, the convexities and/or concavities also expand and contract together with movement of the body, and it is very interesting since the pattern on the garment changes.

Further, according to the method of the present invention, not only convexities and/or concavities are formed in the cloth of garment but also the surface of the cloths of garment may have many variations. More specifically, if different material such as a polyurethane sheet is adhered to the surface of the cloth, leather like feeling and amusing expression by partially breaking upon expanding the convexities and/or concavities can be obtained.

Further, according to the method of the present invention, in the process wherein the cloths including thermoplastic fiber are overlaid on the thermo-shrinkable cloth, they are sewn with stitches of a water-soluble threads, the sewn cloths are heated so as to thermally contract the thermo-shrinkable cloth, and then the water-soluble threads are solved and removed, after stitches are sewn, the sewn cloths are tucked at the former stitches and sewn with tuck stitches in parallel with the former stitches with water-soluble threads. Thus, clear convexities and concavities like as rib-knitting or big convexities and concavities like as rope knitting pattern can be formed in a cloth, and clear convexities and concavities can also be formed in thick cloths. Further, a garment which has such clear convexities and concavities in the cloths thereof can be obtained.

What is claimed is:

1. Method for forming convexities and/or concavities on cloths of a garment comprising:

cutting a cloth or cloths including thermoplastic fiber into parts of the garment;

sewing the parts into a shape of the garment;

laying at least one piece of thermo-shrinkable cloth on the cloths of the garment after or before said sewing;

sewing the thermo-shrinkable cloth, and the cloths of the garment with stitches of water-soluble threads, wherein after the cloths including the thermoplastic fiber and thermo-shrinkable cloth are overlaid and sewn together with the stitches of the water-soluble threads the thermo-shrinkable cloth is cut at least at one position between an adjacent row of stitches;

heating and setting the sewn cloths by heating means under dry condition and without applying any pressure to the cloths so as to permit the thermo-shrinkable cloth to shrink and form convexities and/or concavities on the cloths of the garment; and solving and removing the water-soluble thread so as to separate the cloth of the garment from the thermo-shrinkable cloth.

2. Method according to claim 1, in which said convexities and concavities are gathers.

3. Method according to claim 1, which further comprises subjecting the cloth or cloths of the garment to sublimation transfer printing before or after solving and removing the water-soluble thread.

4. Method according to claim 1, which further comprises adhering a sheet material to the cloth or cloths of garment after said solving and removing.

5. Method for forming convexities and/or concavities on cloths of a garment comprising:

overlaying cloths including thermoplastic fiber, cloths of parts of the garment made by cutting the cloth or cloths, or cloths of a garment made by sewing the parts on a thermo-shrinkable cloth and sewing the thermo-shrinkable cloth to the thermo-plastic cloth or cloths forming a garment together with first stitches of water-soluble threads;

sewing the sewn cloths with second stitches of water-soluble threads parallel to the first stitches in such a manner that the sewn cloths are picked up and tucked around the first stitches;

heating and setting the stitched cloths so as to permit the thermo-shrinkable cloth to shrink and form convexities and/or concavities on the cloths; and solving and removing the water-soluble threads so as to separate the cloths of the garment from the thermo-shrinkable cloth.

6. Method according to claim 5, wherein the tucked width upon making tucks in the cloths sewn by the first stitches is between 1 to 20 mm.

7. Method according to claim 5, wherein upon making tucks in the cloths sewn by the first stitches, the picking up is alternately performed from the front side and the back side of the stitched cloths.

8. Method according to claim 5, wherein three rows of first stitches make a set, each rows of first stitches locating at the center of the tuck upon picking up the cloths sewn by the first stitches and the distance between adjacent rows of the first stitches being between 10 and 20 mm, the sewn cloths are picked up at the first stitches locating at the center of the set by a wide picking up width toward the cloth including the thermoplastic fiber and are tucked with the second stitches of the water-soluble thread, the sewn cloths are picked up at the rows of the first stitches locating at both sides of the set by a narrow picking up width toward the thermo-shrinkable cloth and are tucked with the second stitches of the water-soluble thread, and the stitched cloths are heated and the water-soluble threads are solved and removed, whereby a large projection is formed in the cloths including the thermoplastic fiber as a result of cooperation of the set of the three rows of first stitches and the second stitches forming three tucks at the three rows of first stitches.

9. Method according to claim 5, wherein after the cloths including the thermoplastic fiber and thermo-shrinkable cloth are overlaid and sewn together with the stitches of the water-soluble threads, the thermo-shrinkable cloth is cut at least at one position between an adjacent row of stitches, and thereafter, the sewn cloths are heated.

10. Method for forming convexities and/or concavities on cloths of a garment comprising:

filling filler between a cloth for right side including thermoplastic fibers and a cloth for lining including theremoplastic fibers and a cloth for lining including thermoplastic fibers, and quilting them with water-soluble threads to form quilted cloths for a garment;

overlaying the quilted cloths on a thermo-shrinkable cloth and sewing them together with stitches of a water-soluble threads, the sewing being done by a plurality of sets, each set comprising two or three rows of stitches parallel to each other by a distance therebetween and adjacent sets forming a distance at least three times larger than the distance;

heating and setting the sewn cloths so as to permit the thermo-shrinkable cloth to shrink and form convexities and/or concavities on the quilted cloths; and thereafter, solving and removing the water-soluble threads so as to separate the quilted cloths from the thermo-shrinkable cloth.

* * * * *